US010644419B2

(12) United States Patent
Ishida

(10) Patent No.: US 10,644,419 B2
(45) Date of Patent: May 5, 2020

(54) ELECTRIC CONNECTOR AND ELECTRIC CONNECTOR SET

(71) Applicant: SMK Corporation, Tokyo (JP)

(72) Inventor: Yoshiyasu Ishida, Saitama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/505,753

(22) Filed: Jul. 9, 2019

(65) Prior Publication Data

US 2020/0106200 A1 Apr. 2, 2020

(30) Foreign Application Priority Data

Oct. 1, 2018 (JP) ..... 2018-186679

(51) Int. Cl.
*H01R 12/70* (2011.01)
*H01R 13/6581* (2011.01)

(52) U.S. Cl.
CPC ..... *H01R 12/70* (2013.01); *H01R 13/6581* (2013.01)

(58) Field of Classification Search
CPC ..... H01R 12/71; H01R 23/18; H01R 23/68; H01R 13/11
USPC ..... 439/350, 135, 940
See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/716 439/74
6,116,949 A * 9/2000 Costello ..... H01R 13/6485 439/509
6,855,004 B2 * 2/2005 Soh ..... H01L 23/60 439/41
6,955,546 B1 * 10/2005 Huang ..... H01R 13/5213 439/135
7,074,085 B2 * 7/2006 Chen ..... H01R 13/658 439/607.36
7,232,317 B2 * 6/2007 Ookura ..... H01R 13/506 439/660
7,367,816 B2 * 5/2008 Liu ..... H01R 13/26 439/74
7,748,994 B1 * 7/2010 Peng ..... H01R 12/716 439/660

(Continued)

FOREIGN PATENT DOCUMENTS

JP 5972855 B2 8/2016
JP 2018116925 A 7/2018
JP 2018116925 A * 7/2018 ..... H01R 12/7052

*Primary Examiner* — Abdullah A Riyami
*Assistant Examiner* — Nader J Alhawamdeh

(57) ABSTRACT

An electric connector includes a connector housing configured to be able to be protrusion-depression engaged with a connector housing of a counterpart electric connector in an opposed direction; a plurality of connection terminal rows arranged approximately in the same plane in the connector housing; a conductive member having conductive first plates attached to the connector housing on both outsides of the connection terminal rows in a row direction of connection terminals; and a conductive reinforcing metal piece extending along the connector housing. The reinforcing metal piece is mounted on the connector housing in such a state that at least part of the reinforcing metal piece overlaps with at least part of the first plates.

7 Claims, 18 Drawing Sheets

(56) References Cited

U.S. PATENT DOCUMENTS

| | | | | |
|---|---|---|---|---|
| 7,922,499 | B2 * | 4/2011 | Liao | H01R 12/714 439/660 |
| 8,272,881 | B2 * | 9/2012 | Miyazaki | H01R 12/716 439/345 |
| 8,292,635 | B2 * | 10/2012 | Little | H01R 12/7029 439/570 |
| 8,992,233 | B2 * | 3/2015 | Miyazaki | H01R 12/707 439/74 |
| 2004/0018756 | A1 * | 1/2004 | Pan | H01R 13/6271 439/74 |
| 2010/0130068 | A1 * | 5/2010 | Peng | H01R 13/2457 439/660 |
| 2010/0190383 | A1 * | 7/2010 | Yamada | H01R 13/6315 439/680 |
| 2011/0165797 | A1 * | 7/2011 | Takeuchi | H01R 12/716 439/660 |
| 2011/0250800 | A1 * | 10/2011 | Guo | H01R 12/716 439/660 |
| 2013/0012074 | A1 * | 1/2013 | Mashiyama | H01R 12/73 439/660 |
| 2013/0023162 | A1 * | 1/2013 | Harlan | H01R 12/73 439/660 |
| 2013/0280926 | A1 * | 10/2013 | Ono | H01R 12/712 439/65 |
| 2014/0227910 | A1 * | 8/2014 | Tanaka | H01R 12/7052 439/626 |
| 2015/0207248 | A1 * | 7/2015 | Takenaga | H01R 12/716 439/74 |

* cited by examiner

ELECTRIC CONNECTOR AND ELECTRIC CONNECTOR SET

CROSS REFERENCE TO RELATED APPLICATION

The contents of the following Japanese patent application are incorporated herein by reference, Japanese Patent Application No. 2018-186679 filed on Oct. 1, 2018.

FIELD

The present invention relates to an electric connector and an electric connector set, and in particular, to a socket or plug type electric connector to be mounted on a circuit substrate and capable of being protrusion-depression fit into a counterpart electric connector, and an electric connector set including a socket and a plug.

BACKGROUND

Flat plate-shaped electric connectors to be mounted on substrates have been conventionally used as connectors that connect flexible circuit substrates to circuit substrates, and the like.

As this type of electric connectors, for example, there is known a multipolar connector configured such that a first connector and a second connector are fit to each other, in which the first and second connectors are each provided with a plurality of terminal rows, and a conductive shield member is provided between the terminal rows in order to prevent electromagnetic interference between the terminal rows (see, for example, Patent Literature 1).

In the multipolar connector described in Patent Literature 1, in particular, a shield member 68 is provided between two rows of internal terminals 62 of a second connector 54, and second external terminals 66 are provided in such positions as to at least partly enclose the two rows of internal terminals 62 and the shield member 68 (see, in particular, paragraph 0079 and FIG. 14).

As another connector of this type, for example, there is known a connector having power terminals in which first and second elastic arms 35 and 36 extend to opposite side walls 14 of a housing 10, and first and second contact portions 35C and 36C are formed at distal ends of the first and second elastic arms 35 and 36, respectively, for the purpose of maintaining sufficient elasticity with respect to a counterpart connector, without upsizing the connector (see, for example, Patent Literature 2, in particular, paragraphs 0008, 0034, and 0036 and FIGS. 5 and 7).

CITATION LIST

Patent Literature

Patent Literature 1: Japanese Patent Application Laid-Open No 2018-116925.

Patent Literature 2: Japanese Patent No 5972855

SUMMARY

Technical Problem

However, the electric connector described in Patent Literature 1 is lacking in stiffness, because the shield member and the external terminals are composed of separate components having small contact areas. When the connector is fit into a counterpart connector, if a force acts in a rotational direction due to the counterpart connector fit therein, the shield member inside the connector and the external terminals outside thereof tend to be deformed by the force applied separately, and therefore there is a concern about causing damage to the connector.

On the other hand, in the connector described in Patent Literature 2, since the first contact portion and the second contact portion are asymmetrically disposed across a center line of the connector in a longitudinal direction, the posture of the counterpart connector is tilted at the time of the fitting, so that there is a concern about causing unstable electric connection.

Accordingly, an object of the present invention is to provide an electric connector that has a high stiffness sufficient to resist damage by a force relating to fit and removal of a counterpart connector, as well as having stable electric connection, and an electric connector set.

Solution to Problem

To achieve the above-described object, an electric connector according to an aspect of the present invention includes a connector housing configured to be able to be protrusion-depression engaged with a connector housing of a counterpart connector in an opposed direction; a plurality of connection terminal rows arranged approximately in the same plane in the connector housing; a conductive member having conductive first plates attached to the connector housing on both outsides of the connection terminal rows in a row direction of connection terminals; and a conductive reinforcing metal piece extending along the connector housing. The reinforcing metal piece is mounted on the connector housing in such a state that at least part of the reinforcing metal piece overlaps with at least part of the first plates.

With such a configuration, in the electric connector according to the aspect of the present invention, at least part of the reinforcing metal piece overlaps with at least part of the first plates, so that the electric connector can have an increased stiffness and hence can resist damage by a force applied by the counterpart connector at the time of protrusion-depression engagement. Furthermore, the reinforcing metal piece and the first plates of the conductive member can have increased contact areas, the electric connector can have an increased stiffness, and when the first plates are used as power terminals, the electric connector is capable of achieving stable electric connection to the counterpart connector.

In the electric connector according to the aspect of the present invention, the conductive member may further include a conductive second plate that is provided in the connector housing and extends between the connection terminal rows in the row direction of the connection terminals. The first plates and the second plate may be joined into an integral piece.

With such a configuration, in the electric connector of the aspect of the present invention, since the first plates and the second plate are attached to the connector housing as the integral piece, the electric connector can have a further increased stiffness sufficient to resist damage as compared to the case of attaching only the first plates.

In the electric connector according to the aspect of the present invention, the conductive member may have joint plates configured to join the first plates and the second plate, and the joint plates may be orthogonal to plate surfaces of the first plates and a plate surface of the second plate.

With such a configuration, the electric connector of the aspect of the present invention can secure a high stiffness so as to be resistant to deformation against forces applied from different directions to the plate surfaces of the first plates and the plate surface of the second plate orthogonal to the plate surfaces of the first plates, at the time of fit and removal of the counterpart connector. The improved stiffness makes the electric connector resistant to damage by the forces relating to fit and removal of a counterpart connector, and can stabilize electric connection.

In the electric connector according to the aspect of the present invention, the joint plates may be exposed from the connector housing outward in the row direction of the connection terminal rows.

With such a configuration, in the electric connector according to the aspect of the present invention, since the exposed joint plates abut against an external surface of the connector housing of the counterpart connector, the electric connector can have a further increased stiffness.

In the electric connector according to the aspect of the present invention, the conductive member may have elastic holding members that are provided in the first plate on both sides in a row width direction of the connection terminal rows, and configured to elastically hold the counterpart connector by engaging with engagement portions of the counterpart connector at the time of protrusion-depression engagement. The reinforcing metal piece may have a cover portion configured to cover the elastic holding members from above.

With such a configuration, the electric connector according to the aspect of the present invention can realize stable electric connection without having an influence on the posture of the counterpart connector, while preventing interference of the counterpart connector with the elastic holding members, when the counterpart connector is fit into, or removed from, the electric connector.

In the electric connector according to the aspect of the present invention, the elastic holding members may be composed of a pair of spring members that are provided in the first plate in positions opposite each other on both sides in a direction perpendicular to the row direction of the connection terminal rows.

With such a configuration, the electric connector according to the aspect of the present invention can prevent a tilt in the posture of the counterpart connector and unstable electric connection, as compared with a case where the elastic holding members are provided asymmetrically.

To achieve the above-described object, an electric connector set according to the aspect of the present invention is configured to include the above-described electric connector according to the aspect of the present invention and the counterpart connector.

With such a configuration, in the electric connector set according to the aspect of the present invention, the electric connector, which is protrusion-depression engaged with the counterpart connector, is configured such that at least part of the reinforcing metal piece overlaps with at least part of the first plates of the conductive member, so that the electric connector has a high stiffness and hence can resist damage by a force applied by the counterpart connector at the time of the protrusion-depression engagement. In the electric connector set, on the side of the electric connector, which is protrusion-depression engaged with the counterpart connector, the reinforcing metal piece and the first plates of the conductive member can have increased contact areas, and the electric connector can have an increased stiffness. In addition, when the first plates are used as power terminals, the electric connector can have stable electric connection to the counterpart connector.

According to the aspects of the present invention, it is possible to provide the electric connector that has a high stiffness sufficient to resist damage by a force relating to fit and removal of the counterpart connector, as well as having stable electric connection, and the electric connector set.

DESCRIPTION OF EMBODIMENTS

Figure 1:
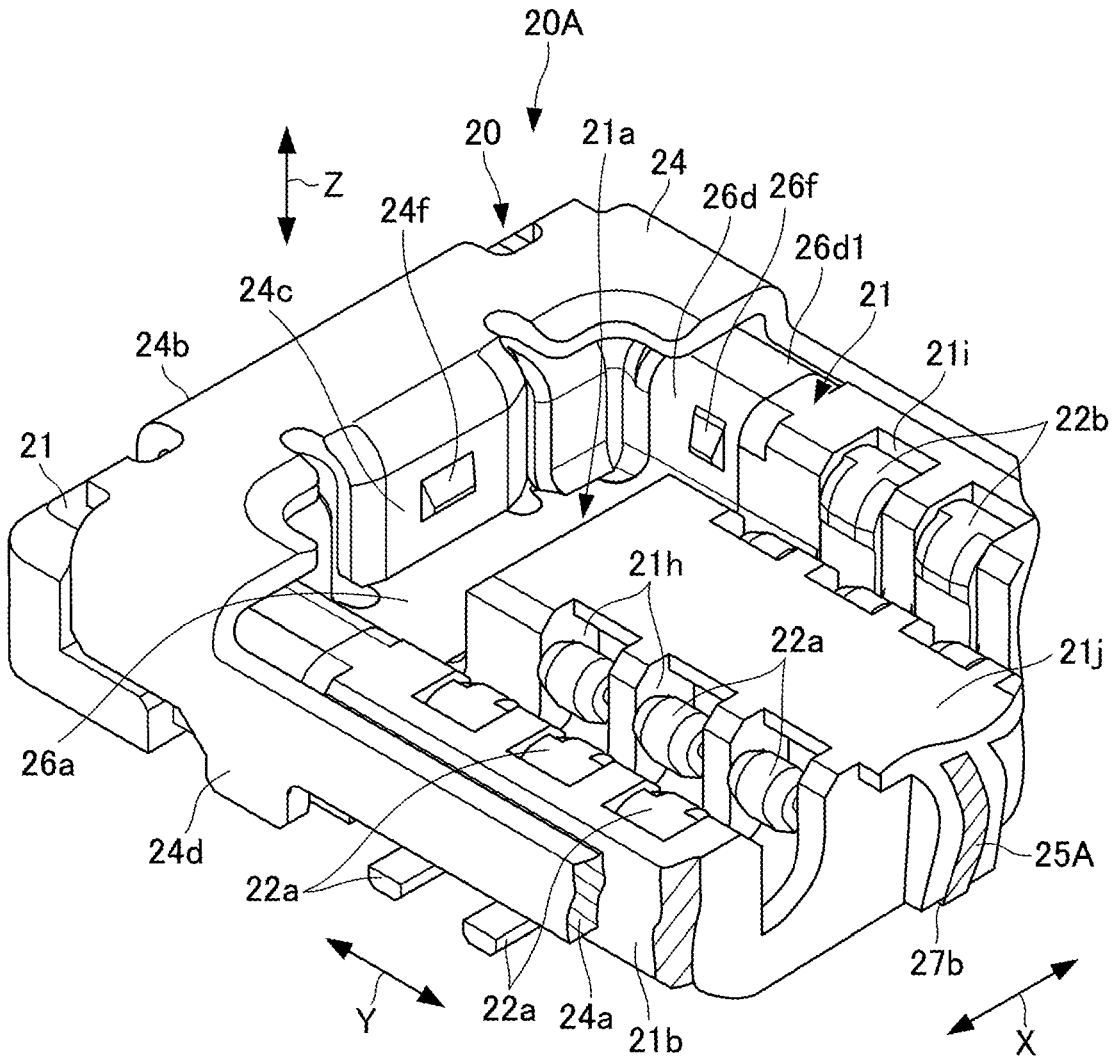
FIG. 1 is a perspective view, including a partly broken cross section, of a portion of an electric connector (socket) according to a first embodiment of the present invention.
Figure 2:
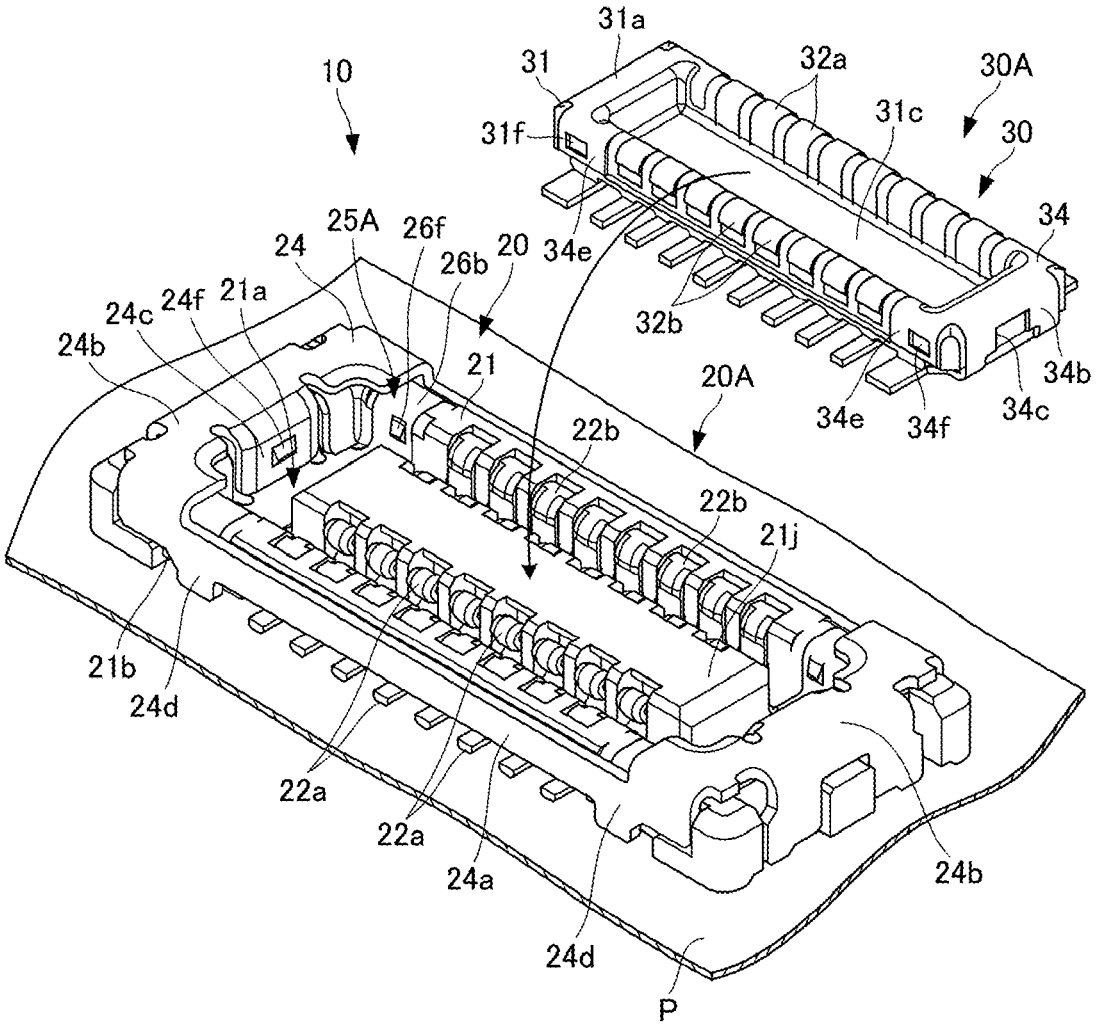
FIG. 2 is an exploded perspective view of an electric connector set according to the first embodiment of the present invention.

Embodiments of the present invention will be described below with reference to the drawings.

First Embodiment

FIGS. 1 to 11B show an electric connector according to a first embodiment of the present invention.

In the following description, the configuration of the electric connector will be described by mainly taking a socket-side electric connector 20A as an example, but the present invention can also be applied to a plug-side electric connector 30A.

As shown in FIGS. 1 to 3B, an electric connector set 10 according to the present embodiment has a socket-shaped electric connector 20A and a plug-shaped electric connector 30A that are protrusion-depression engaged with each other in an opposed direction.

A connector body 20 of the electric connector 20A includes a connector housing 21 that is made of a synthetic resin by injection molding so as to be mainly depressed on the side of a top surface and approximately flat on the side of a bottom surface, and conductive members 25A (see FIG. 6) that have portions (first plates 26) provided outside a plurality of male or female, e.g. female connection terminal rows 22*a* and 22*b* arranged approximately in the same plane (coplanarly) in the connector housing 21 in a row direction of the connection terminals and portions (second plates 27) provided between the connection terminal rows 22*a* and 22*b*.

As shown in FIGS. 1 to 4B, the connector housing 21 includes a depressed fitting portion 21*a* in the shape of, for example, a rectangular ring-shaped groove, an external surface 21*b* extending along the depressed fitting portion 21*a*, a substrate facing surface 21*c* (see FIG. 3B) that faces a circuit substrate P (see FIG. 2), and a middle protrusion 21*j* that is provided in a protruding manner in the middle of a surface in which the depressed fitting portion 21*a* is formed, and has a plurality of rows of terminal holders 21*h* and 21*i* arranged along the groove shape of the depressed fitting portion 21*a*.

The connection terminal rows 22*a* and 22*b* function as receptacle contacts that are fit into the terminal holders 21*h* and 21*i* of the connector housing 21, in which an X direction in FIG. 1 is defined as a row width direction. Each of the receptacle contacts is retained and held in the connector housing 21.

As illustrated in FIGS. 2 to 5B, a connector body 30 of the counterpart electric connector 30A includes a connector housing 31 mainly having a protruding shape on one surface, and a plurality of the other type of female and male, for example, male connection terminal rows 32*a* and 32*b* that are coplanarly arranged in the connector housing 31.

The connector housing 31 includes a protruding fitting portion 31*a* in the shape of, for example, a rectangular ring projection, an external surface 31*b* (see FIG. 5A) extending along the protruding fitting portion 31*a*, and a middle depressed portion 31*c* situated inside the protruding fitting portion 31*a*.

The connection terminal rows 32*a* and 32*b* are plug contacts that are integrally attached to the protruding fitting portion 31*a* of the connector housing 31. External end portions of the connection terminal rows 32*a* and 32*b* are arranged in parallel with each other.

The connector bodies 20 and 30 of the electric connector 20A and the counterpart electric connector 30A are provided with conductive reinforcing metal pieces 24 and 34, respectively.

As shown in FIGS. 1 to 4B and 8, the connector body 20 of the electric connector 20A has the conductive reinforcing metal piece 24 mounted on the corresponding connector housing 21. The reinforcing metal piece 24 is made of a sheet metal into a predetermined shape by pressing. The reinforcing metal piece 24 has a pair of long side plate portions 24*a* extending along the external surface 21*b* of the connector housing 21 on both sides in a lateral direction, a pair of connection plate portions 24*b* extending along the external surface 21*b* of the connector housing 21 on the outside of the depressed fitting portion 21*a* of the connector housing 21, pairs of internal and external end plate portions 24*c* that are bent from the pair of connection plate portions 24*b* so as to protrude to the side of an inner depth (downward) of the depressed fitting portion 21*a*, and pairs of bent joint portions 24*d* that are joined to the pair of long side plate portions 24*a* and the pair of connection plate portions 24*b* at both ends and have bent shapes bent in the middle.

In the reinforcing metal piece 24, the pairs of internal and external end plate portions 24*c* are provided with engagement protruding portions 24*f* that are engaged with stepwise depressed portions 34*c* of the electric connector 30A, when the counterpart electric connector 30A is protrusion-depression engaged.

The reinforcing metal piece 24 is attached to the connector housing 21 such that the pairs of internal and external end plate portions 24*c* overlap with at least part of reinforcing metal piece joint portions of the conductive members 25A at both ends of the connector housing 21 in a longitudinal direction (see FIGS. 9A to 11B). Note that, the conductive member 25A includes the first plate 26 having side end plates 26*b*, 26*c*, and 26*d* (see FIG. 6) as the reinforcing metal piece joint portions, though the configuration thereof will be described later in detail with reference to FIG. 6. Furthermore, the conductive member 25A has a plurality of approximately square protruding ground connection portions 26*a*1 and 27*b* (see FIG. 3B) that are exposed to the side of the substrate facing surface 21*c* of the corresponding connector housing 21 of the connector body 20. Therefore, the reinforcing metal piece 24 is mechanically and electrically joined to the conductive members 25A, and due to connection to a ground portion of the circuit substrate P through the conductive members 25A, the reinforcing metal piece 24 can be ground-shielded.

Pairs of bottom ends of the pair of end plate portions 24*c* and bottom ends of the pairs of bent joint portions 24*d* of the reinforcing metal piece 24 are disposed approximately coplanarly or set at a predetermined protrusion height with respect to bottom surfaces of the connection terminal rows 22*a* and 22*b* and bottom surfaces of the ground connection portions 26*a*1 and 27*b* (see FIGS. 3B and 4B) of the conductive members 25A of the connector housing 21.

Figure 5A:
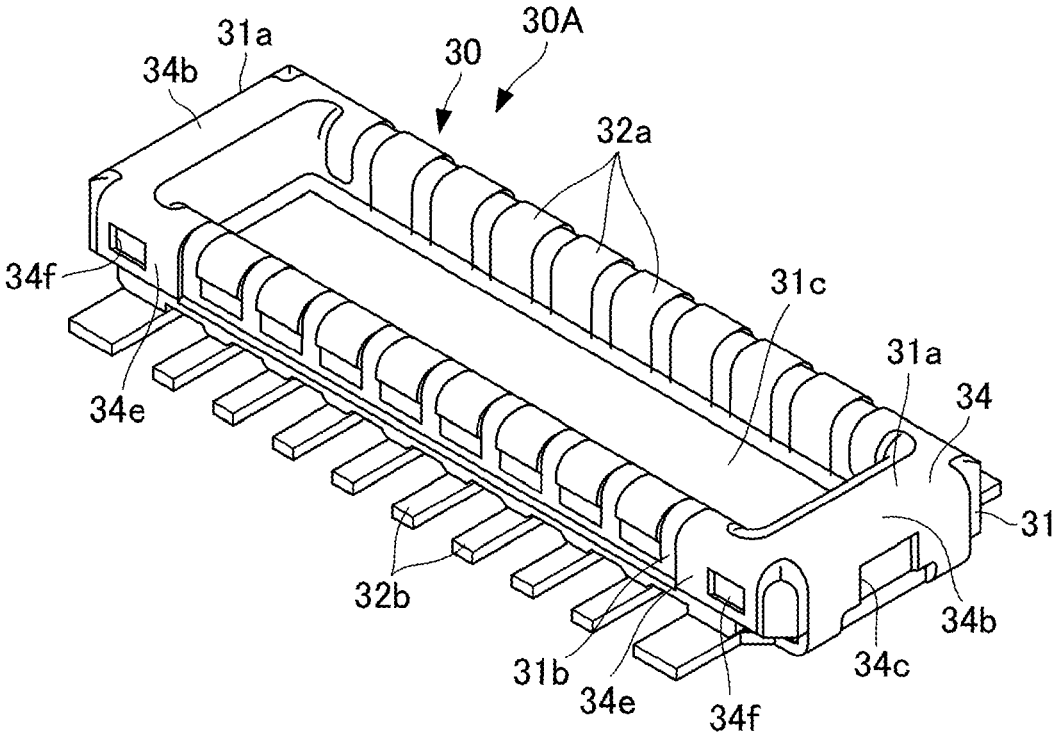
FIG. 5A is an exterior perspective view of the electric connector (plug) according to the first embodiment of the present invention, showing its exterior on a bottom side having a protruding shape.
Figure 5B:
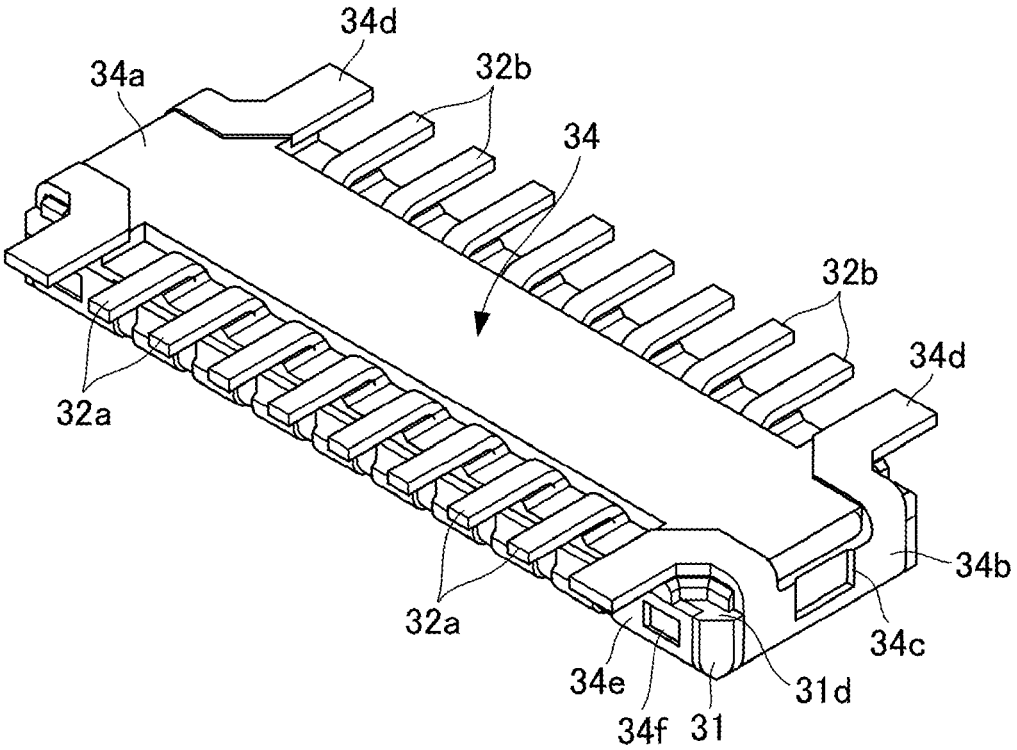
FIG. 5B is an exterior perspective view of the electric connector (plug) according to the first embodiment of the present invention, showing its exterior on a top side.

As shown in FIGS. 5A and 5B, the reinforcing metal piece 34 provided in the connector body 30 of the counterpart electric connector 30A has a top cover 34*a* (see FIG. 5B) extending throughout a top surface 31*d* of the connector housing 31 in the longitudinal direction, both end plate portions 34*b* that cover both end surfaces of the connector housing 31 in the longitudinal direction and bottom surfaces in the vicinities thereof, the stepwise depressed portions 34*c* formed at part of both the end plate portions 34*b*, pairs of attachment handles 34*d* extending from both the end plate portions 34*b* to the top surface of the connector housing 31, and pairs of side plate portions 34*e* that extend from both the end plate portions 34*b* to both the side surfaces of the connector housing 31. Out of them, in each pair of side plate portions 34*e*, engagement depressed portions 34*f* with which engagement protruding portions 26*f* (see FIG. 6) provided in the conductive member 25A are engaged, when being protrusion-depression engaged with the electric connector 20A, to hold the engagement are formed.

Figure 6:
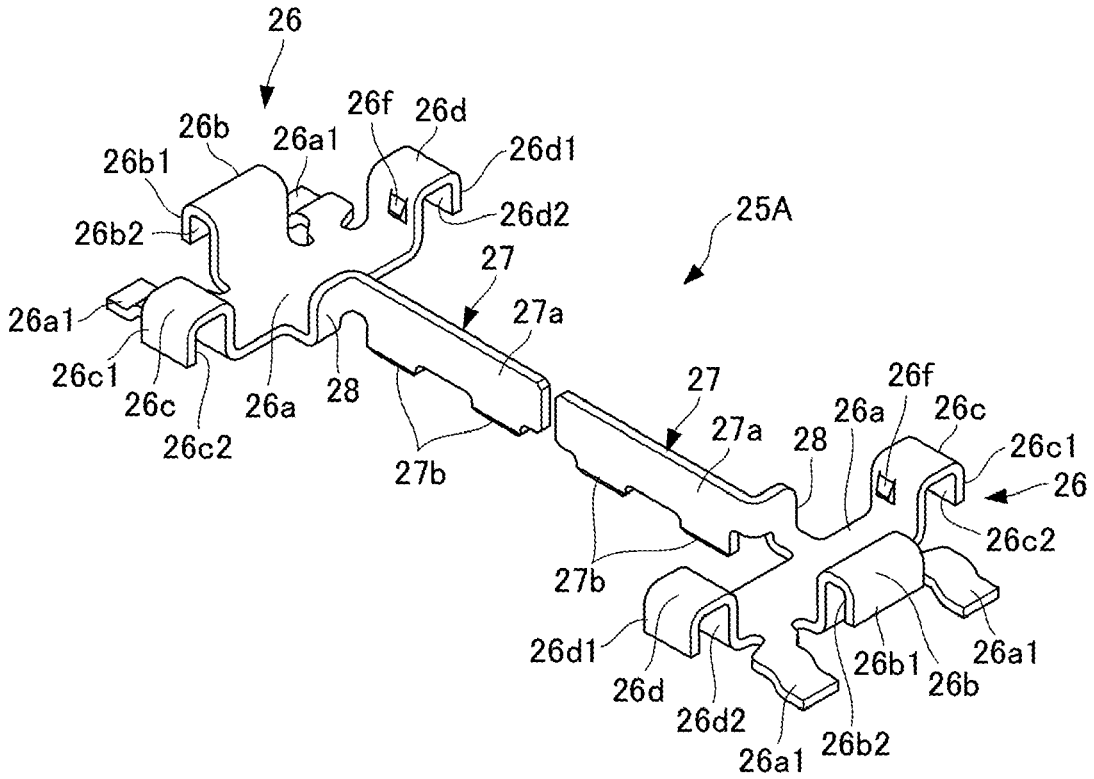
FIG. 6 is a perspective view of conductive members to be attached to a connector housing of the electric connector (socket) according to the first embodiment of the present invention.
Figure 7:
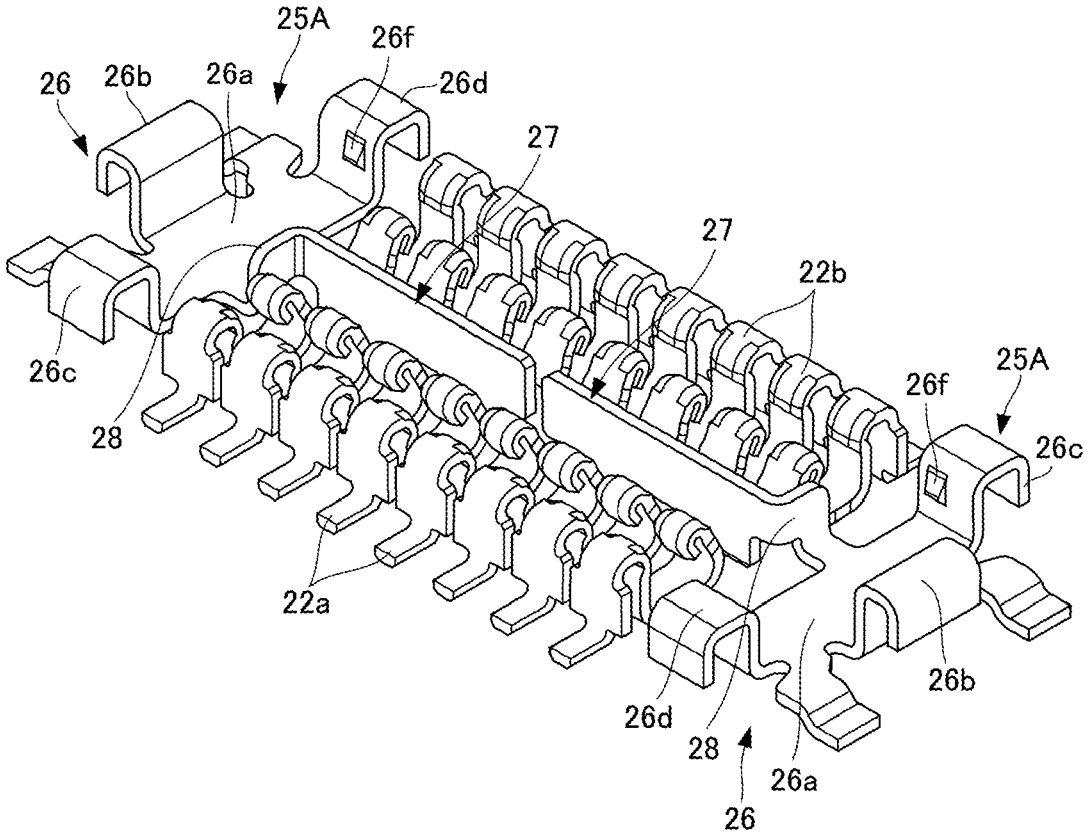
FIG. 7 is a perspective view showing a disposition state of the conductive members and connection terminal rows in the connector housing of the electric connector (socket) according to the first embodiment of the present invention.

Next, the configuration of the conductive members 25A and the reinforcing metal piece 24 attached to the connector housing 21 of the electric connector 20A will be described in detail. FIG. 6 is a perspective view showing the configuration of the conductive members 25A, and FIG. 7 is a perspective view showing a disposition state of the conductive members 25A and the connection terminal rows 22*a* and 22*b*.

As shown in FIG. 6, the conductive member 25A is made of a conductive member, and has the first plate 26, the second plate 27, and a joint plate 28 for joining the first plate 26 and the second plate 27. In the connector housing 21, the first plates 26 are attached to the connector housing 21 on both outsides of the connection terminal rows 22*a* and 22*b* in the row direction of the connection terminals, and the second plates 27 extend between the connection terminal rows 22*a* and 22*b* in the row direction of the connection terminals.

The electric connector 20A according to the present embodiment is specifically configured such that the two conductive members 25A having the above-described structure are arranged in the row direction of the connection terminals of the connection terminal rows 22*a* and 22*b* so as to bring end portions of the second plates 27 on the opposite sides to the first plates 26 close to each other. As a modified example of the configuration shown in FIG. 6, the second plates 27 may be joined into one, and the first plates 26 may be formed on both opposite ends of the single second plate 27. As to the configuration of the modified example, the same goes for modified examples of conductive members 25B and 25C according to second and third embodiments, which will be described later.

As shown in FIG. 6, each of the two conductive members 25A is composed of an integral piece in which the first plate 26 and the second plate 27 are joined with the joint plate 28. In the conductive member 25A, the joint plate 28 is orthogonal to a plate surface 26*a* of the first plate 26 and a plate surface 27*a* of the second plate 27. The joint plate 28 is preferably exposed from the connector housing 21 on the outsides of the connection terminal rows 22*a* and 22*b* in the row direction. To be more specific, the joint plates 28 are preferably disposed in a state of being exposed from side surfaces on both ends of the middle protrusion 21*j* of the connector housing 21 in the row direction of the connection terminal rows 22*a* and 22*b* and of being partly in contact with the side surfaces.

Out of the first plate 26 and the second plate 27 of the conductive member 25A, the second plate 27 is made of a plate member having a plate surface 27*a*, which is a flat surface extending in an engagement and disengagement direction (Z direction in FIG. 1) of the connector bodies 20 and 30 of the electric connector 20A and the counterpart electric connector 30A and in the row direction (Y direction in FIG. 1) of the connection terminal rows 22*a* and 22*b*. In the second plate 27, the ground connection portions 27*b* are formed on a bottom end side surface of the plate surface 27*a* at predetermined intervals along the row direction (Y direction in FIG. 1) of the connection terminal rows 22*a* and 22*b*.

In the conductive member 25A, the first plate 26 has the plate surface 26*a*, which is a flat surface extending in the engagement and disengagement direction and in the row width direction (X direction in FIG. 1) of the connection terminal rows 22*a* and 22*b*, and the side end plates 26*b*, 26*c*, and 26*d* erected from three end portions, except for a connection end to the joint plate 28, of the plate surface 26*a* along the engagement and disengagement direction.

The side end plate 26*b* is erected from an end portion, opposite the connection end of the joint plate 28, of the plate surface 26*a*. The side end plate 26*b* is a portion with which the pairs of internal and external end plate portions 24*c* of the reinforcing metal piece 24 partly overlaps, when the reinforcing metal piece 24 is mounted on the connector housing 21 to which the conductive members 25A are attached. The pairs of internal and external end plate portions 24*c* of the reinforcing metal piece 24 overlaid on the side end plates 26*b* define both side ends of the depressed fitting portion 21*a* of the connector housing 21 in the row direction of the connection terminal rows 22*a* and 22*b*. Note that, in the plate surface 26*a* from which the side end plate 26*b* is erected, the pair of ground connection portions 26*a*1, part of which extend outside at both sides of the side end plate 26*b*, are formed.

The side end plates 26*c* and 26*d* are erected from end portions, adjacent to the connection end of the joint plate 28, of the plate surface 26*a*. The side end plates 26*c* and 26*d* define both side ends of the depressed fitting portion 21*a* of the connector housing 21 in the row width direction of the connection terminal rows 22*a* and 22*b*.

In the first plate 26, the side end plate 26*b* has a curved extending portion 26*b*1 that protrudes outside in the row direction of the connection terminal rows 22*a* and 22*b* at a top end portion and is bent outside a base portion of the side end plate 26*b*. The extending portion 26*b*1 forms a groove portion 26*b*2 between its distal end portion and an unbent portion (the base portion of the side end plate 26*b*) of the side end plate 26*b*. In the same manner, in the first plate 26, the side end plates 26*c* and 26*d* have curved extending portions 26*c*1 and 26*d*1 that protrude outside in the row width direction of the connection terminal rows 22*a* and 22*b* and are bent outside base portions of the side end plates 26*c* and 26*d*, respectively. The extending portions 26*c*1 and 26*d*1 form groove portions 26*c*2 and 26*d*2 between each of their distal end portions and each of unbent portions (base portions) of the side end plates 26*c* and 26*d*.

The groove portions 26*b*2, 26*c*2, and 26*d*2 formed in the first plate 26 of the conductive member 25A function as engagement depressed portions with which engagement protruding portions formed in the connector housing 21 correspondingly to the groove portions 26*b*2, 26*c*2, and 26*d*2 are engaged, respectively. As the above-described engagement protruding portions, the connector housing 21 has row-directional engagement portions 21*e* (see FIGS. 9A and 9B) that are engaged with the groove portions 26*b*2 of the pair of side end plates 26*b* on both outsides in the row direction of the connection engagement portions 22*a* and 22*b*, and row width-directional fitting portions 21*f* (see FIG. 10) that are engaged with the groove portions 26*c*2 and 26*d*2 of the side end plates 26*c* and 26*d*, respectively, on both outsides in the row width direction of the connection terminal rows 22*a* and 22*b*.

In the conductive member 25A, the engagement protruding portion 26*f*, which is engaged with the engagement depressed portion 34*f* provided in the connector body 30 of the counterpart electric connector 30A, is formed in each of the side end plates 26*c* and 26*d* of the first plate 26. The engagement protruding portions 26*f* are composed of a pair of elastic projection members provided symmetrically on both sides in the row width direction of the connection terminal rows 22*a* and 22*b*. A pair of the engagement protruding portions 26*f* are provided on each of both sides in the row direction of the connection terminal rows 22*a* and 22*b*.

In the electric connector 20A including the connector housing 21 to which the two conductive members 25A having the configuration shown in FIG. 6 are attached, the two conductive members 25A and the connection terminal rows 22*a* and 22*b* have, for example, a positional relationship as shown in FIG. 7 in the connector housing 21. More specifically, the two conductive members 25A and the connection terminal rows 22*a* and 22*b* are disposed such that the second plates 27 of the individual conductive members 25A are inserted between the connection terminal rows 22*a* and 22*b*. In this disposition state, each of the conductive members 25A is ground-connected (grounded) to the circuit substrate P (see FIG. 2) on the side of the substrate facing surface 21*c* of the connector housing 21 through the ground connection portions 27*b* provided in the second plate 27, thus functioning as a shield member between the connection terminal rows 22*a* and 22*b*.

Note that, when a ground shield plate is disposed in each of the connection terminal rows 22*a* and 22*b*, the conductive member 25A may be connected to the ground shield plate in each of the connection terminal rows 22*a* and 22*b*, but the ground shield plate in each of the connection terminal rows 22*a* and 22*b* may be directly connected to a ground portion on the side of the circuit substrate P, without being connected to the conductive member 25A.

The conductive members 25A are integrated into the connector housing 21 by insert molding, or press-fit into the molded connector housing 21.

In the electric connector 20A according to the present embodiment, the two conductive members 25A and the connection terminal rows 22*a* and 22*b* are insert molded by, for example, disposing the two conductive members 25A and the connection terminal rows 22*a* and 22*b* in a frame of the connector housing 21 in the positional relationship shown in FIG. 7 and pouring a synthetic resin into the frame. In an exploded perspective view of the connector housing 21 shown in FIG. 8, a lower part shows external structure of the connector housing 21 obtained by insert molding.

Figure 4A:
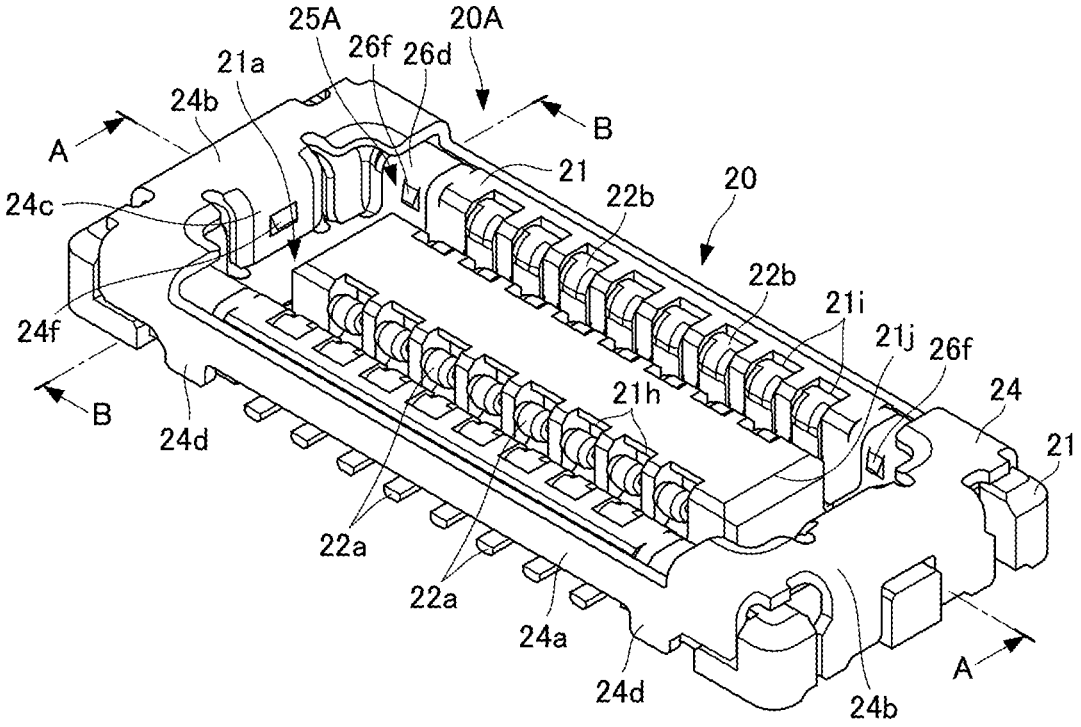
FIG. 4A is an exterior perspective view of the electric connector (socket) according to the first embodiment of the present invention, showing its exterior on a top side.
Figure 4B:
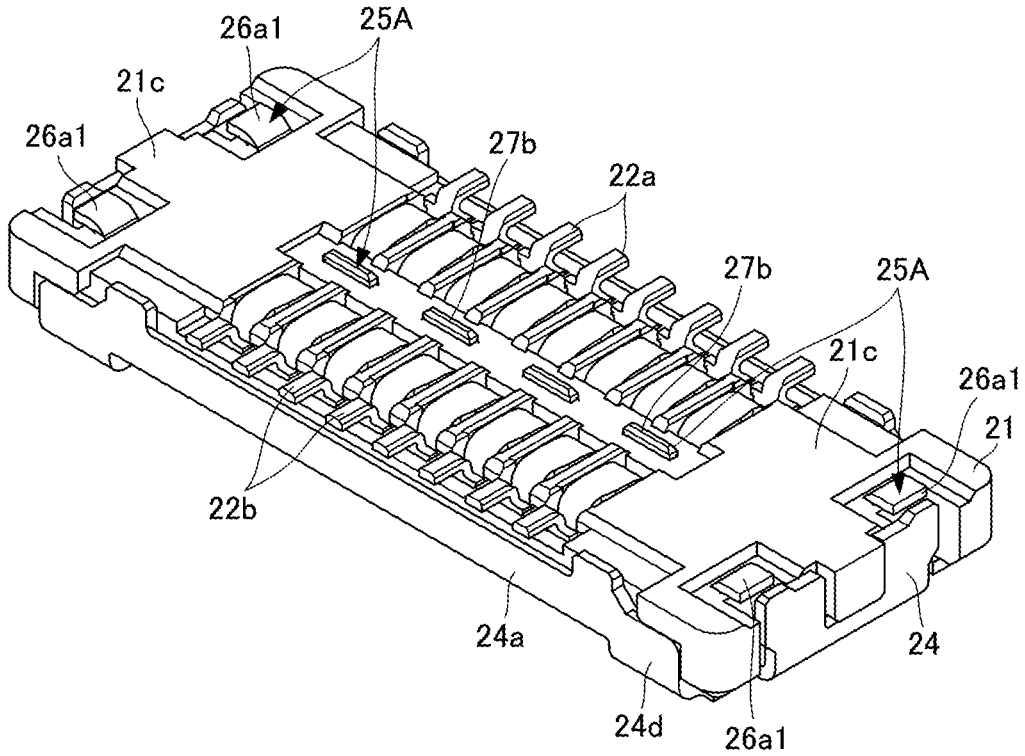
FIG. 4B is an exterior perspective view of the electric connector (socket) according to the first embodiment of the present invention, showing its exterior on a bottom side.
Figure 8:
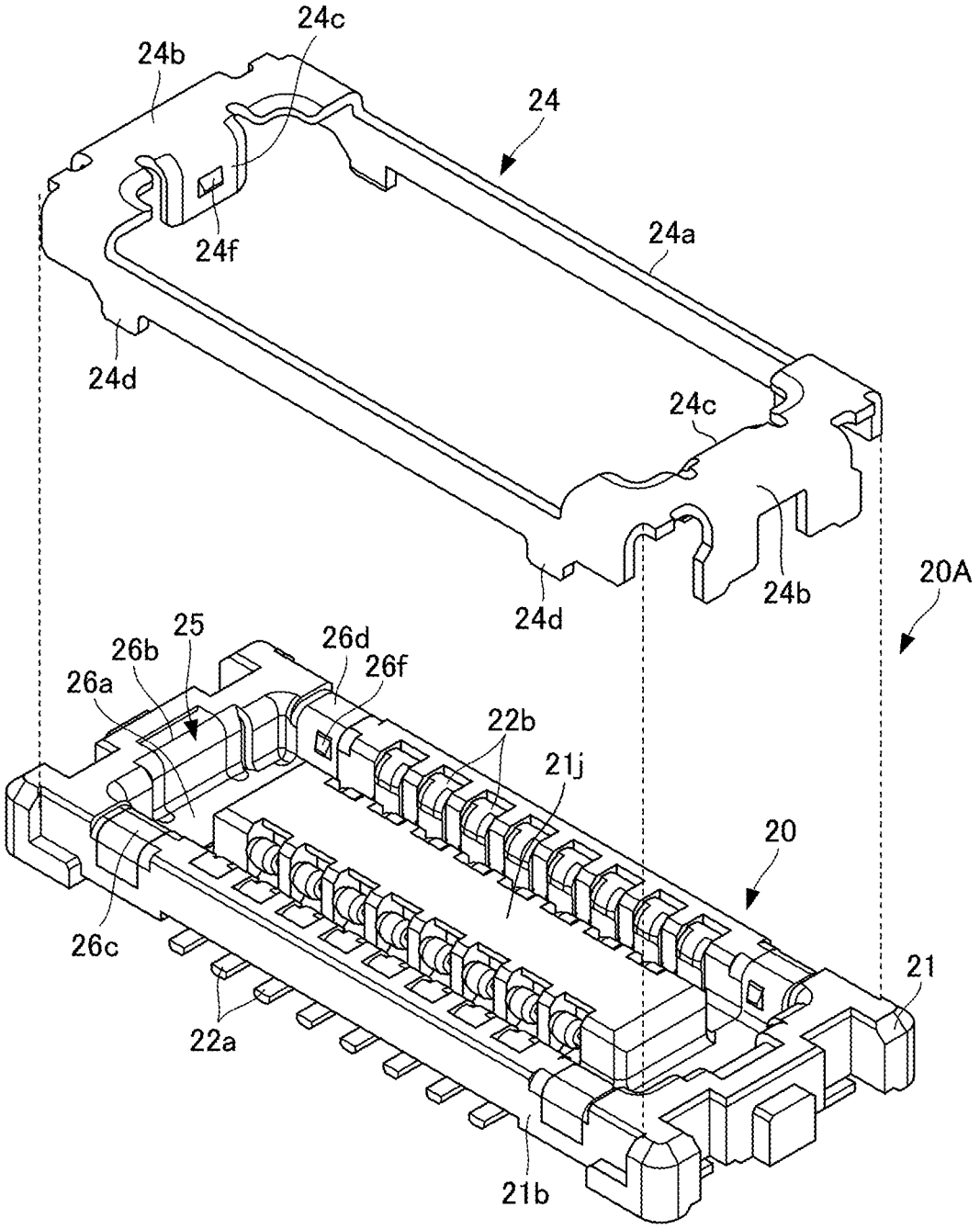
FIG. 8 is an exploded perspective view of the electric connector (socket) according to the first embodiment of the present invention, and an upper side shows an exterior of a reinforcing metal piece, and a lower side shows an exterior of the connector housing to which the conductive members are attached.

As shown in FIG. 8, the connector housing 21 obtained by insert molding can become, for example, the electric connector 20A having the connector body 20 having the structure shown in FIG. 4A by mounting the reinforcing metal piece 24 (see an upper part of FIG. 8) thereon from above.

Figure 9A:
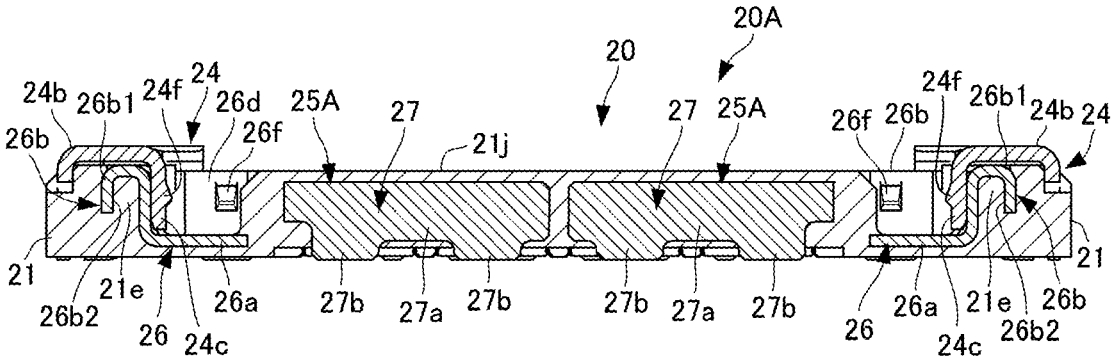
FIG. 9A is a longitudinal cross-sectional view of the electric connector (socket) according to the first embodiment of the present invention.
Figure 9B:
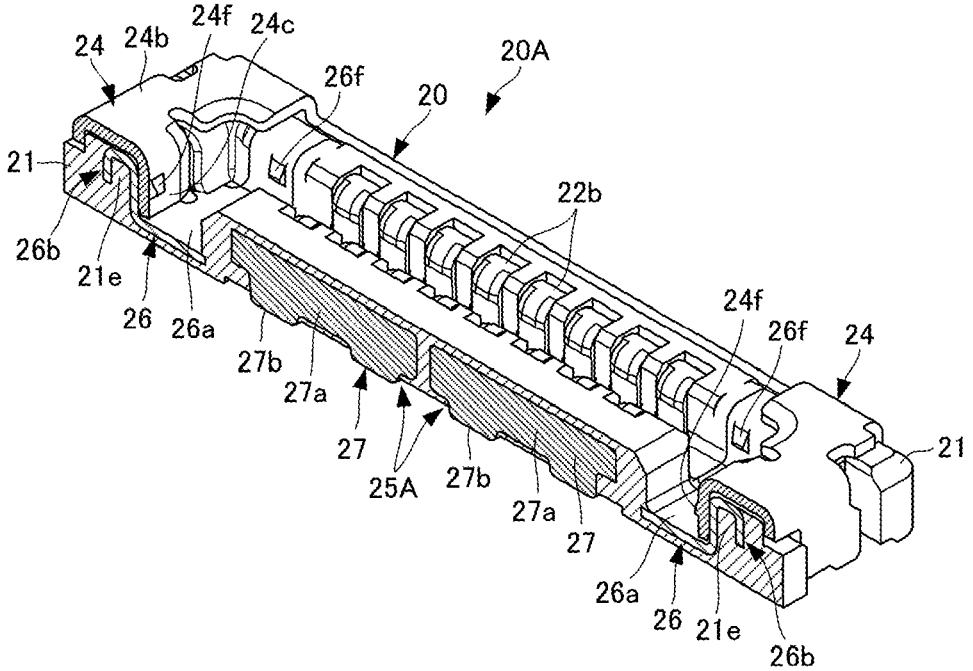
FIG. 9B is a perspective view of the socket including a longitudinal cross section.
Figure 10:
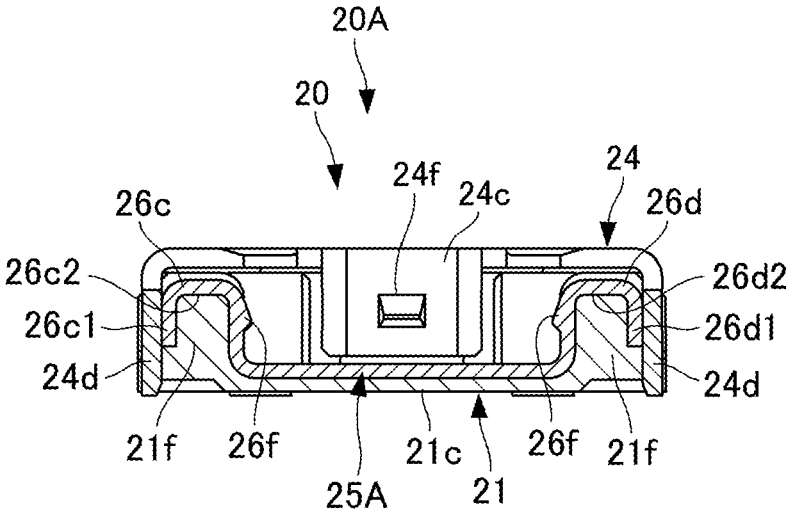
FIG. 10 is a transverse cross-sectional view of a longitudinal end portion of the electric connector (socket) according to the first embodiment of the present invention.

FIG. 9A is a longitudinal cross-sectional view taken along line A-A of the connector of the electric connector 20A shown in FIG. 4A, and FIG. 9B shows a perspective view of the electric connector 20A including a longitudinal cross section shown in FIG. 9A. FIG. 10 is a cross-sectional view taken along line B-B of the electric connector 20A shown in FIG. 4A.

As shown in FIGS. 9A and 9B, as to the relationship between the connector housing 21 and the conductive members 25A, in the electric connector 20A according to the present embodiment, the row-directional engagement portions 21*e* of the connector housing 21 are engaged with the groove portions 26*b*2 of the side end plates 26*b* of the first plates 26 of the conductive members 25A at both ends of the connector housing 21 in the longitudinal direction. As to the relationship between the conductive members 25A and the reinforcing metal piece 24, part of the internal surfaces of the pair of connection plate portions 24*b* of the reinforcing metal piece 24 partly overlap with the top surfaces of the extending portions 26*b*1 of the side end plates 26*b* of the first plates 26 of the conductive members 25A. Furthermore, the internal surfaces of the pairs of internal and external end plate portions 24*c* of the reinforcing metal piece 24 are in contact with the base portions of the side end plates 26*b* of the first plates 26 of the conductive members 25A.

In the electric connector 20A, as to the relationship between the connector housing 21 and the conductive members 25A, as shown in FIG. 10, the row width-directional engagement portions 21*f* of the connector housing 21 are engaged with the groove portions 26*c*2 and 26*d*2 of the side end plates 26*c* and 26*d* of the first plates 26 of the conductive members 25A at both ends in the lateral direction of the connector housing 21. As to the relationship between the conductive members 25A and the reinforcing metal piece 24, the internal surfaces of the pairs of bent joint portions 24*d* of the reinforcing metal piece 24 are in contact with the external surfaces of the extending portions 26*c*1 and 26*d*1 of the side end plates 26*c* and 26*d* of the first plates 26 of the conductive members 25A.

Figure 3A:
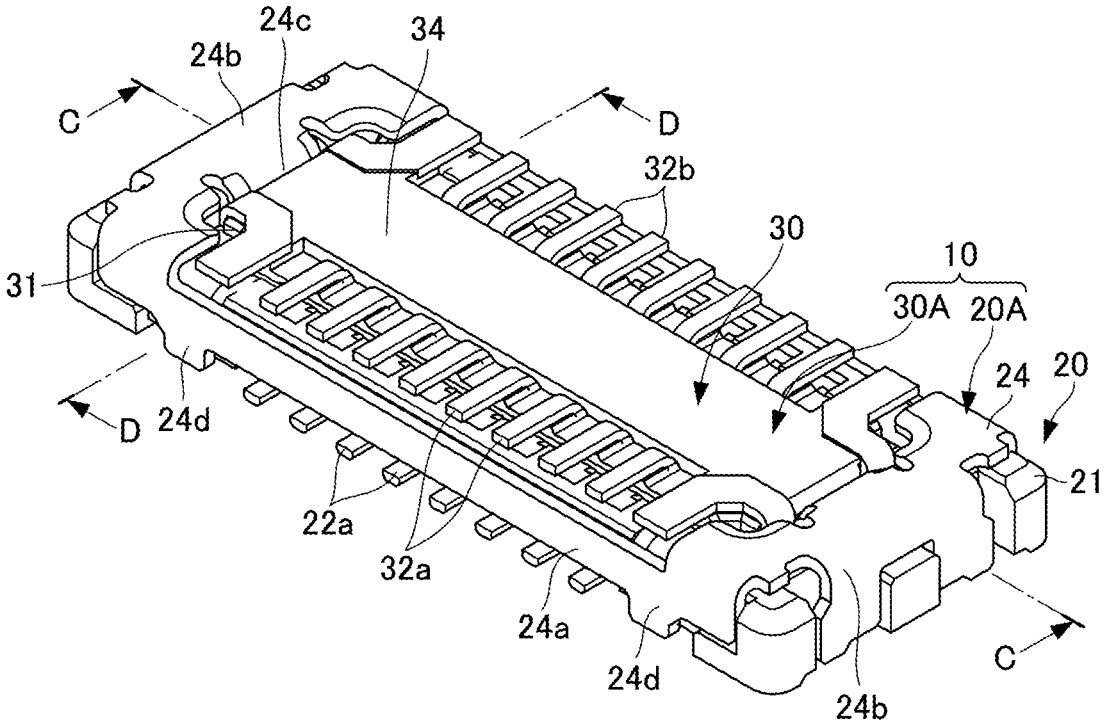
FIG. 3A is a perspective view showing a male-female coupling state of a socket and a plug of the electric connector set according to the first embodiment of the present invention, showing its top side.
Figure 3B:
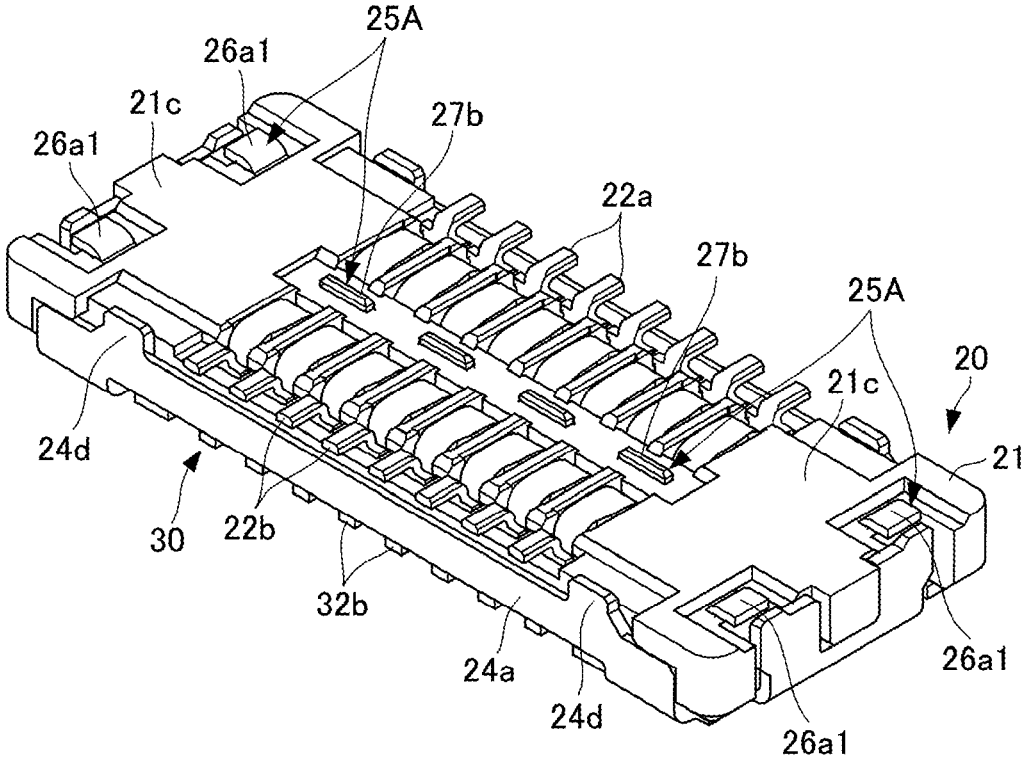
FIG. 3B a perspective view showing the male-female coupling state of the socket and the plug of the electric connector set according to the first embodiment of the present invention, showing its bottom side.
Figure 11A:
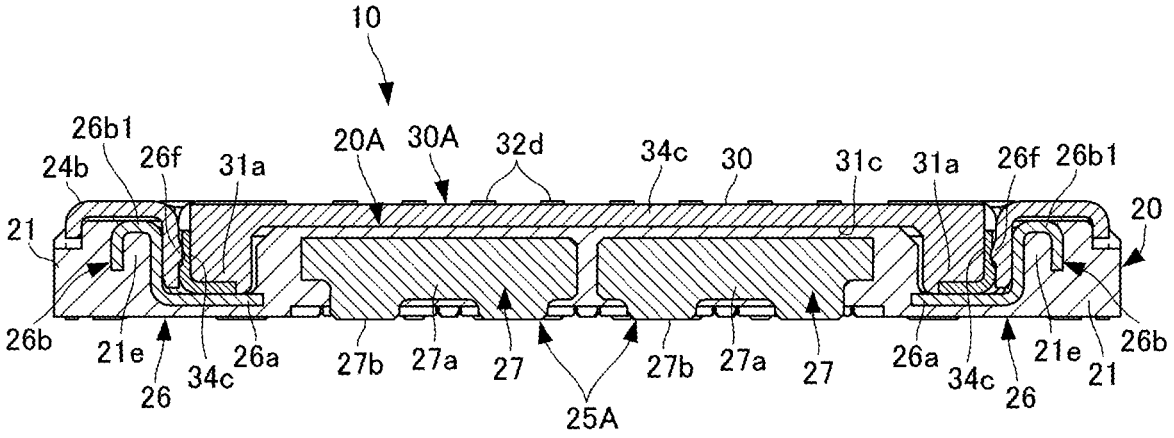
FIG. 11A is a longitudinal cross-sectional view showing a male-female coupling state of the socket and the plug in the electric connector set according to the first embodiment of the present invention.

The electric connector 20A can become the electric connector set 10 having the external structure, as shown in FIGS. 3A and 3B, by being male-female coupled (protrusion-depression engaged) with the counterpart electric connector 30A. FIG. 11A is a longitudinal cross-sectional view (cross-sectional view taken along line C-C of FIG. 3A) of the electric connector set 10, and FIG. 11B is a transverse cross-sectional view (cross-sectional view taken along line D-D of FIG. 3A) of a longitudinal end portion of the electric connector set 10.

Figure 11B:
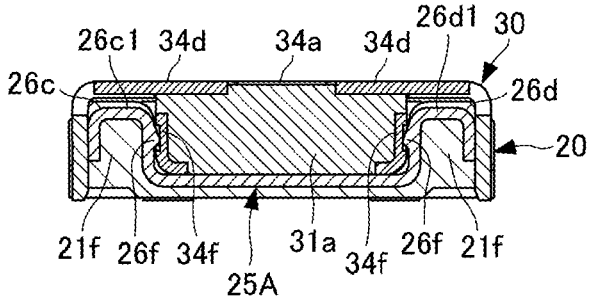
FIG. 11B is a transverse cross-sectional view of a longitudinal end portion of the electric connector set.

As shown in FIGS. 11A and 11B, in the electric connector set 10, the counterpart electric connector 30A can be protrusion-depression engaged with the electric connector 20A in such a state that part of the reinforcing metal piece 24 (pair of connection plate portions 24*b*) is in contact with the top surfaces of the extending portions 26*b*1 of the side end plates 26*b* of the first plates 26 of the conductive members 25A (see FIG. 11A) and the top and external surfaces of the extending portions 26*c*1 and 26*d*1 of the side end plates 26*c* and 26*d* (see FIG. 11B).

In the protrusion-depression engaged electric connector set 10, the side end plates 26*b*, 26*c*, and 26*d* of the conductive members 25A are electrically connected to the pair of connection plate portions 24*b*, the pairs of internal and external end plate portions 24*c*, and the pairs of bent joint portions 24*d* of the reinforcing metal piece 24, and the plate surfaces 26*a* of the first plates 26 of the conductive members 25A are retained with and electrically connected to both the end plate portions 34*b* of the reinforcing metal piece 34 of the counterpart electric connector 30A. Therefore, in the electric connector set 10, when the connector bodies 20 and 30 of the electric connector 20A and the counterpart electric connector 30A are joined, both the reinforcing metal pieces 24 and 34 can be ground-shielded through the conductive members 25A. The retained engagement described herein means a fit state that prevents pullout, for example, a fit state having a depressed portion and a protruding portion in a direction orthogonal to the engagement and disengagement direction, and does not include a combination in which one side is elastically engaged therewith and the other side receives it at a plane.

As described above, in the electric connector 20A according to the present embodiment, the reinforcing metal piece 24 is attached to the connector housing 21 such that at least part of the reinforcing metal piece 24 overlaps with at least part of the first plates 26 of the conductive members 25A (see FIGS. 9A to 11B).

According to the configuration of the electric connector 20A, since at least part of the reinforcing metal piece 24 overlaps with at least part of the first plates 26 of the conductive members 25A, the stiffness of the electric connector 20A can have an increased stiffness and hence can resist damage by a force applied by the counterpart electric connector 30A at the time of protrusion-depression engagement. Since the reinforcing metal piece 24 and the first plates 26 of the conductive members 25A can have increased contact areas, the stiffness can be improved, and in the case of using the first plates 26 as power terminals, it is possible to stabilize electric connection with the counterpart electric connector 30A.

In the electric connector 20A according to the present embodiment, the conductive members 25A have the conductive second plates 27, which are provided in the connector housing 21 and extend between the connection terminal rows 22*a* and 22*b* in the row direction of the connection terminals, and the first plate 26 and the second plate 27 are joined into an integral piece (see FIG. 6).

Therefore, in the electric connector 20A according to the present embodiment, since the first plates 26 and the second plate 27 are attached to the connector housing 21 as the integral piece, the stiffness of the electric connector 20A can be further increased, as compared with the case of attaching only the first plates 26. Therefore, it is possible to further resist damage by a force applied by the counterpart electric connector 30A in protrusion-depression engagement of the electric connector 30A.

In the electric connector 20A according to the present embodiment, the conductive member 25A has the joint plate 28 that joins the first plate 26 and the second plate 27, and the joint plate 28 is orthogonal to the plate surface 26*a* of the first plate 26 and the plate surface 27*a* of the second plate 27.

Accordingly, in fitting and removing the counterpart electric connector 30A, the electric connector 20A according to the present embodiment can have a high stiffness sufficient to resist deformation by forces applied from different directions to the plate surface 26*a* of the first plate 26 and the plate surface 27*a* of the second plate 27 orthogonal to the plate surface 26*a*. The increased stiffness allows resistance to damage by a force relating to fit and removal of the counterpart electric connector 30A, and also allows stabilization of electric connection.

In the electric connector 20A according to the present embodiment, the joint plates 28 are exposed from the connector housing 21 to the outsides of the row direction of the connection terminal rows 22*a* and 22*b*. Therefore, in the electric connector 20A of the present embodiment, the exposed joint plates 28 abut against the external surface of the protruding fitting portion 31*a* of the connector housing 31 of the counterpart electric connector 30A, so that the electric connector 20A can have a further increased stiffness.

The electric connector set 10 according to the present embodiment is composed of the electric connector 20A having the above-described configuration and the electric connector 30A that is protrusion-depression engaged with the electric connector 20A in the opposed direction. According to the configuration of the electric connector set 10, the electric connector 20A, which is protrusion-depression engaged with the counterpart electric connector 30A, is configured such that at least part of the reinforcing metal piece 24 overlaps with at least part of the first plates 26 of the conductive members 25A, thus having a high stiffness. Therefore, even if a force is applied from the counterpart electric connector 30A in protrusion-depression engagement, each of portions including a periphery of the depressed fitting portion 21*a*, the middle protrusion 21*j*, and the like can be resistant to damage. In the electric connector set 10, the electric connector 20A, with which the counterpart electric connector 30A is protrusion-depression engaged, can have large contact areas between the reinforcing metal piece 24 and the first plates 26 of the conductive members 25A, so that when the first plates 26 are used as power terminals, it is possible to stabilize electric connection to the counterpart electric connector 30A.

As described above, the present embodiment can provide the electric connector 20A that has a high stiffness sufficient to resist damage by a force relating to fit and removal of the counterpart electric connector 30A, as well as having stable electric connection, and the electric connector set 10.

Note that, in the electric connector 20A according to the present embodiment, the conductive members 25A do not necessarily have the first plates 26 and the second plates 27 as components to improve a stiffness, and may have only the first plates on the outsides of the row direction of the connection terminal rows 22*a* and 22*b*.

Second Embodiment

Figure 12A:
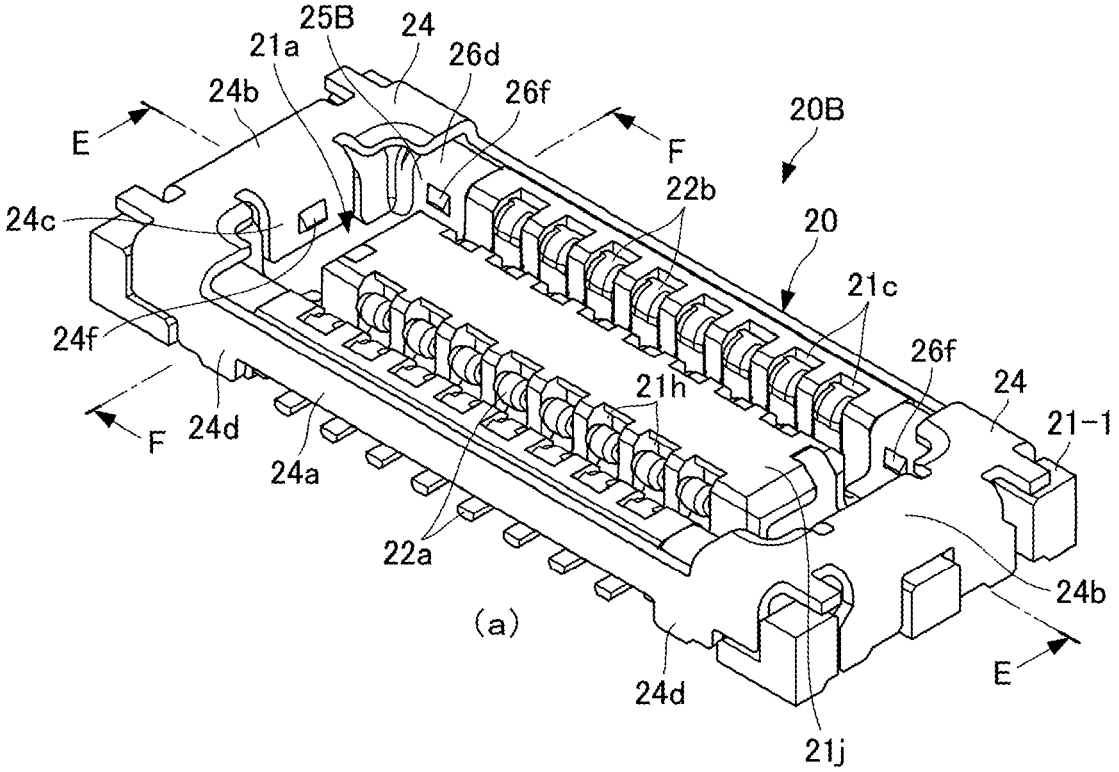
FIG. 12A is an exterior perspective view of an electric connector (socket) according to a second embodiment of the present invention, showing its exterior on a top side.
Figure 12B:
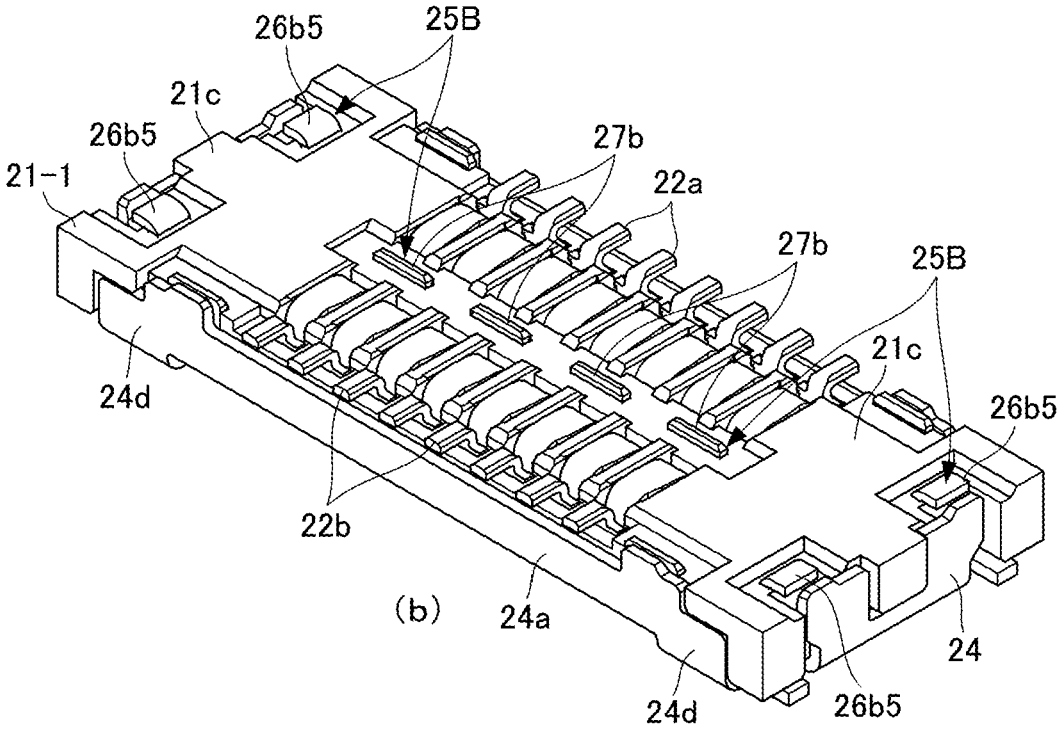
FIG. 12B is an exterior perspective view of the electric connector (socket) according to the second embodiment of the present invention, showing its exterior on a bottom side.
Figure 13:
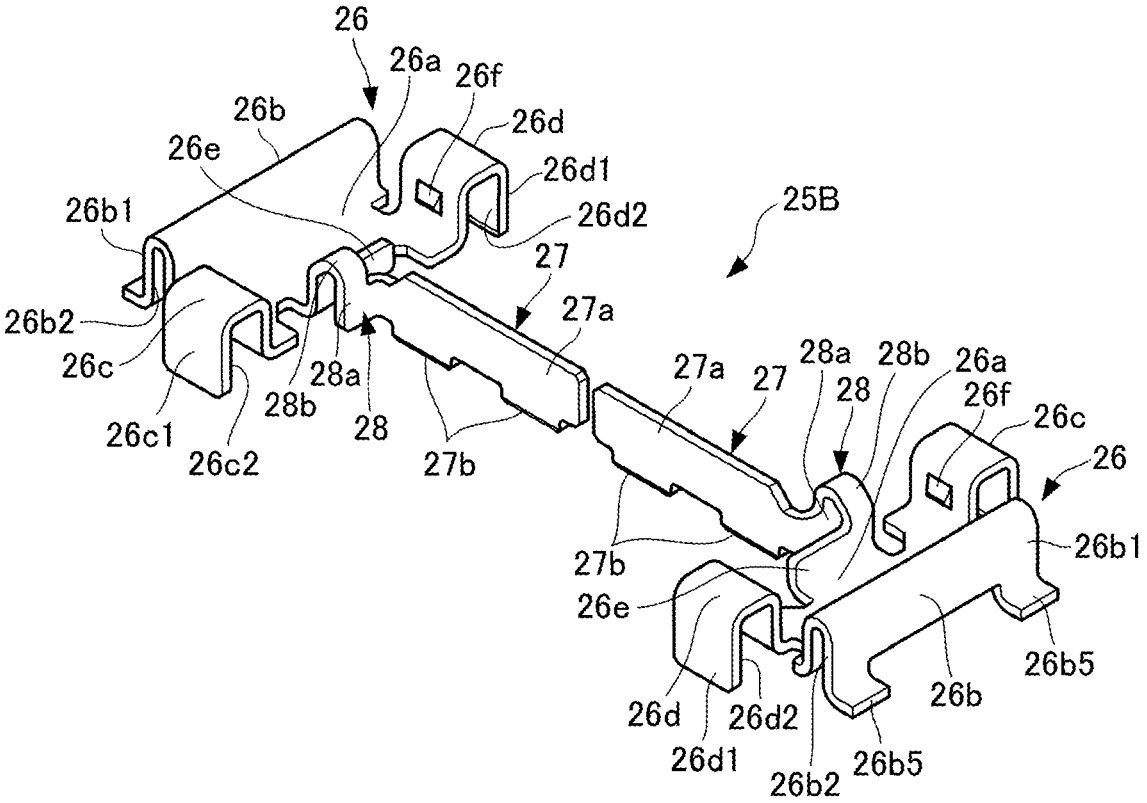
FIG. 13 is a perspective view of conductive members to be attached to a connector housing of the electric connector (socket) according to the second embodiment of the present invention.

FIGS. 12A and 12B include exterior perspective views of an electric connector 20B according to a second embodiment of the present invention, where FIG. 12A shows its exterior on a top side, and FIG. 12B shows its exterior on a bottom side. FIG. 13 is a perspective view showing the configuration of conductive members 25B to be attached to the electric connector 20B according to the present embodiment. Note that, the electric connector 20B according to the present embodiment has the same or similar configuration as the above-described first embodiment, so that in the following description, the components same as, or similar to, those of the first embodiment are dented by the same reference numerals, and differences from the first embodiment will be described.

In the electric connector 20B according to the present embodiment, the conductive members 25B shown in FIG. 13, instead of the conductive members 25A shown in FIG. 6, are attached to a connector housing 21-1, as different configuration from the electric connector 20A according to the first embodiment. The conductive members 25B are similar to the conductive members 25A of the electric connector 20A according to the first embodiment, in terms that the conductive members 25B have conductive first plates 26 attached to the connector housing 21-1 on both outsides of the connection terminal rows 22*a* and 22*b* in the row direction of the connection terminals, and conductive second plates 27 that are provided in the connector housing 21-1 and extend in the row direction of the connection terminals between the connection terminal rows 22*a* and 22*b*, and the first plates 26 and the second plates 27 are joined with the joint plates 28.

As shown in FIG. 13, the conductive member 25B is different from the conductive member 25A according to the first embodiment in the configuration of the first plate 26 and the joint plate 28. In FIG. 13, the first plate 26 of the conductive member 25B has a plate surface 26*a* and side end plates 26*b*, 26*c*, 26*d*, and 26*e*. The side end plates 26*c* and 26*d* of the side end plates 26*b*, 26*c*, 26*d*, and 26*e* are the same as those of the first plate 26 of the conductive member 25A according to the first embodiment. On the contrary, the side end plate 26*b* has a different structure from that of the first plate 26 of the conductive member 25A according to the first embodiment, and no side end plate 26*e* is present in the first plate 26 of the conductive member 25A according to the first embodiment.

In the first plate 26, the side end plate 26*b* has a curved extending portion 26*b*1 that is erected at an opposite end portion of the plate surface 26*a* to the joint plate 28, and protrudes outward in the row direction of the connection terminal rows 22*a* and 22*b*, and is bent outward a base portion of the side end plate 26*b*. By the bending, the extending portion 26*b*1 forms a groove portion 26*b*2 having an opening between its distal end portion and an unbent portion of the side end plate 26*b*. The side end plate 26*b* and the extending portion 26*b*1 are formed wider in the row width direction of the connection terminal rows 22*a* and 22*b* than those of the first embodiment. The extending portion 26*b*1 has a narrower opening distance (distance in the longitudinal direction of the conductive member 25B) than that of the first embodiment, and is bent so as to have a small protrusion amount to the outside in the row direction of the connection terminal rows 22*a* and 22*b* and to draw a circle having a small radius. By the bending, the extending portion 26*b*1 has a smaller opening size in the longitudinal direction of the conductive member 25B than the first embodiment. Furthermore, in the side end plate 26*b*, a pair of ground connection portions 26*b*5 are formed by outwardly bending part of a distal end of the extending portion 26*b*1 on both sides at right angles. The side end plate 26*e* is made of a plate member that is erected at an end portion of the plate surface 26*a* on the side of the joint plate 28 at a predetermined width and height along the engagement and disengagement direction.

On the other hand, as shown in FIG. 13, the joint plate 28 of the conductive member 25B has a first plate member 28*a* and a second plate member 28*b* that is integrally formed with the first plate member 28*a*. The first plate member 28*a* is made of a plate member that is orthogonal to the plate surface 26*a* of the first plate 26 and the plate surface 27*a* of the second plate 27. The second plate member 28*b* is made of a plate member that has a smaller width than the side end plate 26*e* and the first plate member 28*a* and is joined between an upper portion of the side end plate 26*e* and an upper portion of the first plate member 28*a* in an upwardly protruding state (in a bent state). In the conductive member 25B, the first plate 26, the joint plate 28, and the second plate 27 are joined into an integral piece.

As shown in FIG. 12A, in the electric connector 20B, the conductive members 25B having the above-described configuration are attached to the connector housing 21-1, so as to expose the second plate members 28*b* of the individual joint plates 28 from both side ends of the middle protrusion 21*j* of the connector housing 21-1 (both side ends in the row direction of the connection terminal rows 22*a* and 22*b*). At this time, the reinforcing metal piece 24 is mounted on the connector housing 21-1 in such a manner that the pairs of internal and external end plate portions 24*c* partly overlap with the pair of side end plates 26*b* of the conductive member 25B at both ends in the row direction. In the bottom surface side of the electric connector 20B, as shown in FIG. 12B, the ground connection portions 27*b* and 26*b*5 of the conductive member 25B are exposed to the side of the substrate facing surface 21*c* of the connector housing 21-1.

Therefore, in the electric connector 20B, the ground connection portions 27*b* and 26*b*5 of the conductive members 25B are easily ground-connected to the circuit substrate P (see FIG. 2) on the side of the substrate facing surface 21*c* of the connector housing 21-1. In the electric connector 20B, the side end plates 26*b* of the first plates 26 of the individual conductive members 25B attached to the connector housing 21-1 are in contact with the end plate portions 24*c* of the reinforcing metal piece 24-2, and are connected to the reinforcing metal pieces 24-2 and 34 in the row width direction at the outsides of the male and female connection terminal rows 22*a* and 22*b* in the row direction. In this state, a ground shield effect due to the conductive members 25B can be obtained.

Figure 14A:
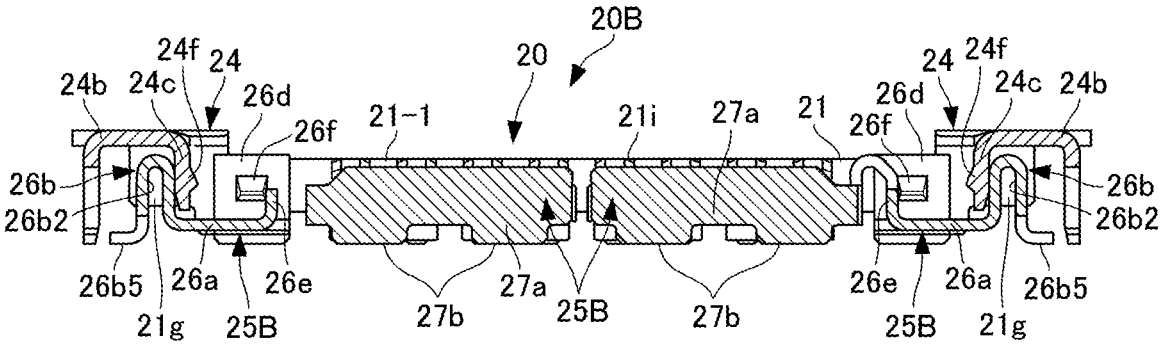
FIG. 14A is a longitudinal cross-sectional view of the electric connector (socket) according to the second embodiment of the present invention.
Figure 14B:
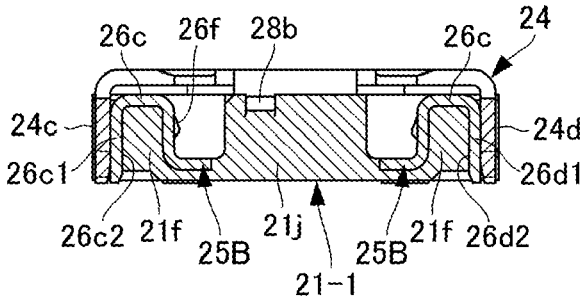
FIG. 14B is a transverse cross-sectional view of a longitudinal end portion of the socket.

In the electric connector 20B having the above-described configuration, the engagement relationship between the connector housing 21-1 and the conductive members 25B, and the engagement relationship between the conductive members 25B and the reinforcing metal piece 24 are, for example, as shown in FIGS. 14A and 14B. FIG. 14A is a longitudinal cross-sectional view of the electric connector 20B taken along line E-E in FIG. 12A, and FIG. 14B is a transverse cross-sectional view of the electric connector 20B taken along line F-F in FIG. 12A.

As shown in FIG. 14A, in the electric connector 20B according to the present embodiment, as to the relationship between the connector housing 21-1 and the conductive member 25B, row-directional engagement portions 21*g* of the connector housing 21-1 are engaged with the groove portions 26*b*2 of the side end plates 26*b* of the first plates 26 of the conductive members 25B at both ends of the connector housing 21-1 in the longitudinal direction. The row-directional engagement portions 21*g* is thin in thickness in the row direction of the connection terminal rows 22*a* and 22*b*, as compared with the above-described row-directional engagement portions 21*e* (see FIG. 9A). As to the relationship between the conductive members 25B and the reinforcing metal piece 24, the reinforcing metal piece 24 is in contact with the extending portions 26*b*1 of the side end plates 26*b* of the first plates 26 of the conductive members 25B.

In the electric connector 20B, as to the relationship between the connector housing 21-1 and the conductive members 25B, as shown in FIG. 14B, the row-directional engagement portions 21*g* of the connector housing 21-1 are engaged with the groove portions 26*c*2 and 26*d*2 of the side end plates 26*c* and 26*d* of the first plates 26 of the conductive members 25B at both ends in the lateral direction. As to the relationship between the conductive members 25B and the reinforcing metal piece 24, the internal surfaces of the pairs of bent joint portions 24*d* of the reinforcing metal piece 24 are in contact with external surfaces of the extending portions 26*c*1 and 26*d*1 of the side end plates 26*c* and 26*d* of the first plates 26 of the conductive members 25B.

As is apparent from FIGS. 14A and 14B, also in the present embodiment, the reinforcing metal piece 24 is mounted on the connector housing 21-1 in such a manner that at least part of the reinforcing metal piece 24 overlaps with at least part of the first plates 26 of the conductive members 25B. Therefore, in the present embodiment, the electric connector 20B can become resistant to damage by a force applied by the counterpart electric connector 30A in protrusion-depression engagement. The reinforcing metal piece 24 and the second plates 27 of the conductive members 25B can have increased contact areas, and in the case of using the first plates 26 as power terminals, it is possible to stabilize electric connection with the counterpart electric connector 30A.

The other configuration is the same as that of the first embodiment described above, and the same effects as those in the first embodiment can be obtained in addition to effects derived from the configuration that the reinforcing metal piece 24 is mounted on the connector housing 21-1 in a state that at least part of the reinforcing metal piece 24 overlaps with at least part of the first plates 26 of the conductive members 25B.

Third Embodiment

Figure 15A:
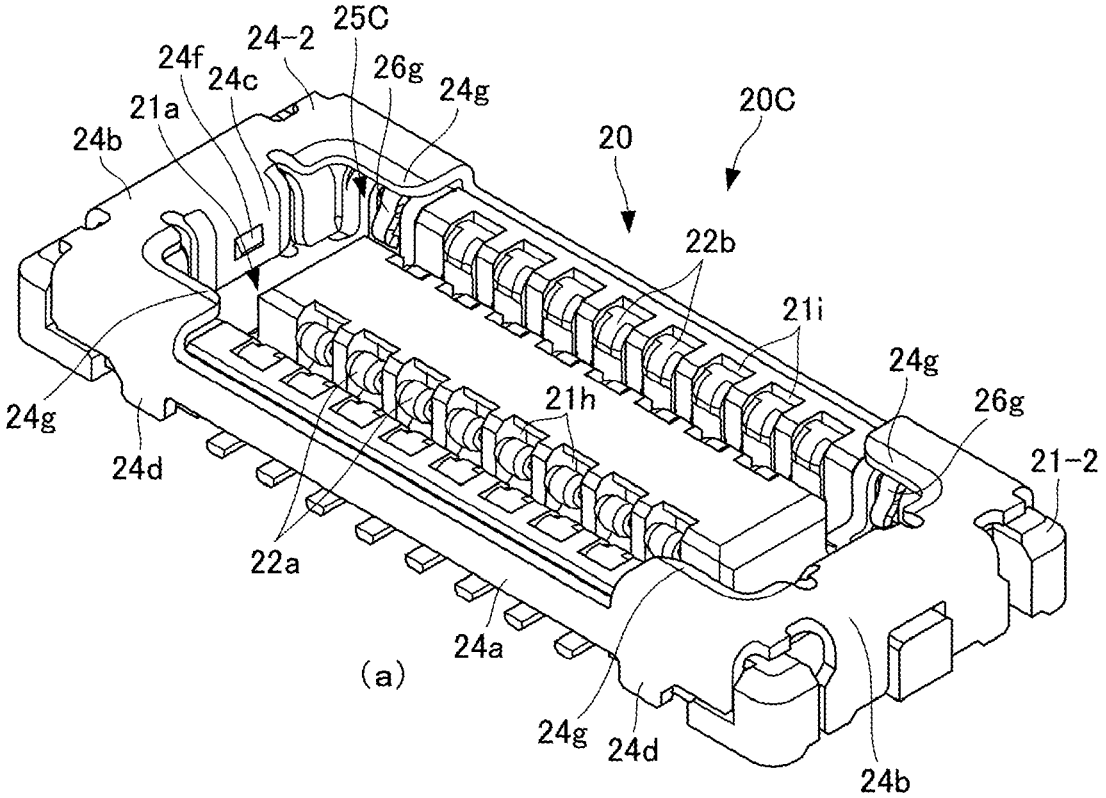
FIG. 15A is an exterior perspective view of an electric connector (socket) according to a third embodiment of the present invention, showing its exterior on a top side.
Figure 15B:
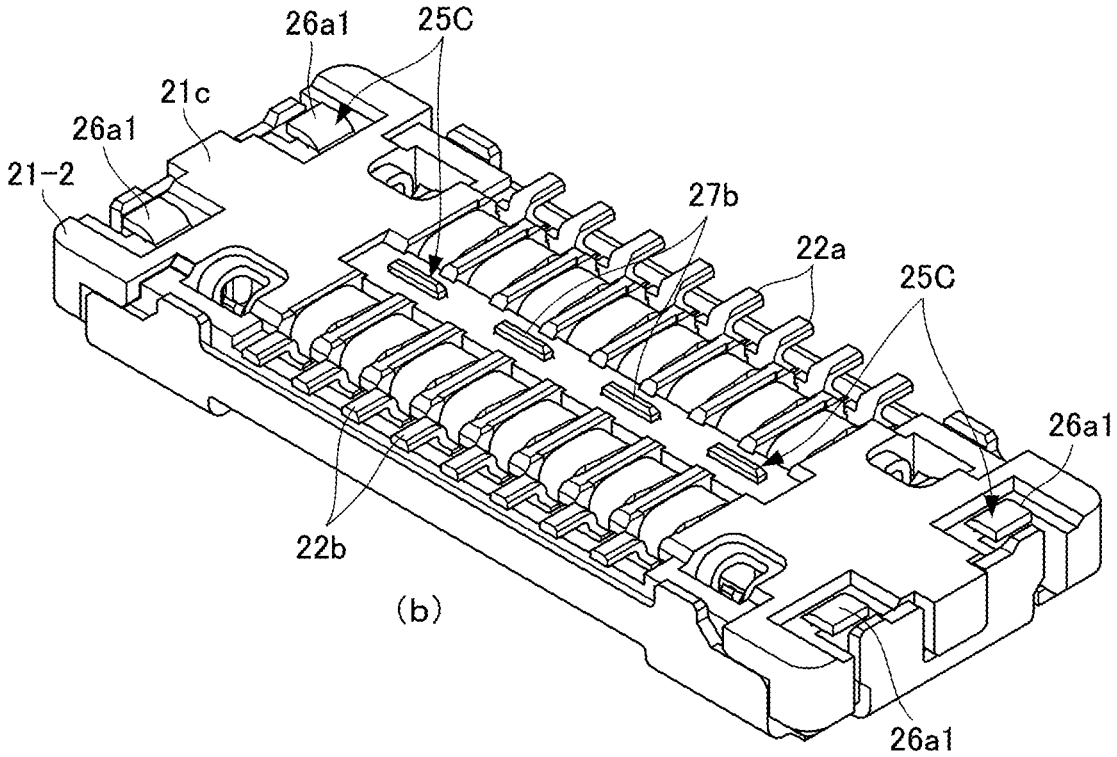
FIG. 15B is an exterior perspective view of the electric connector (socket) according to the third embodiment of the present invention, showing its exterior on a bottom side.
Figure 16:
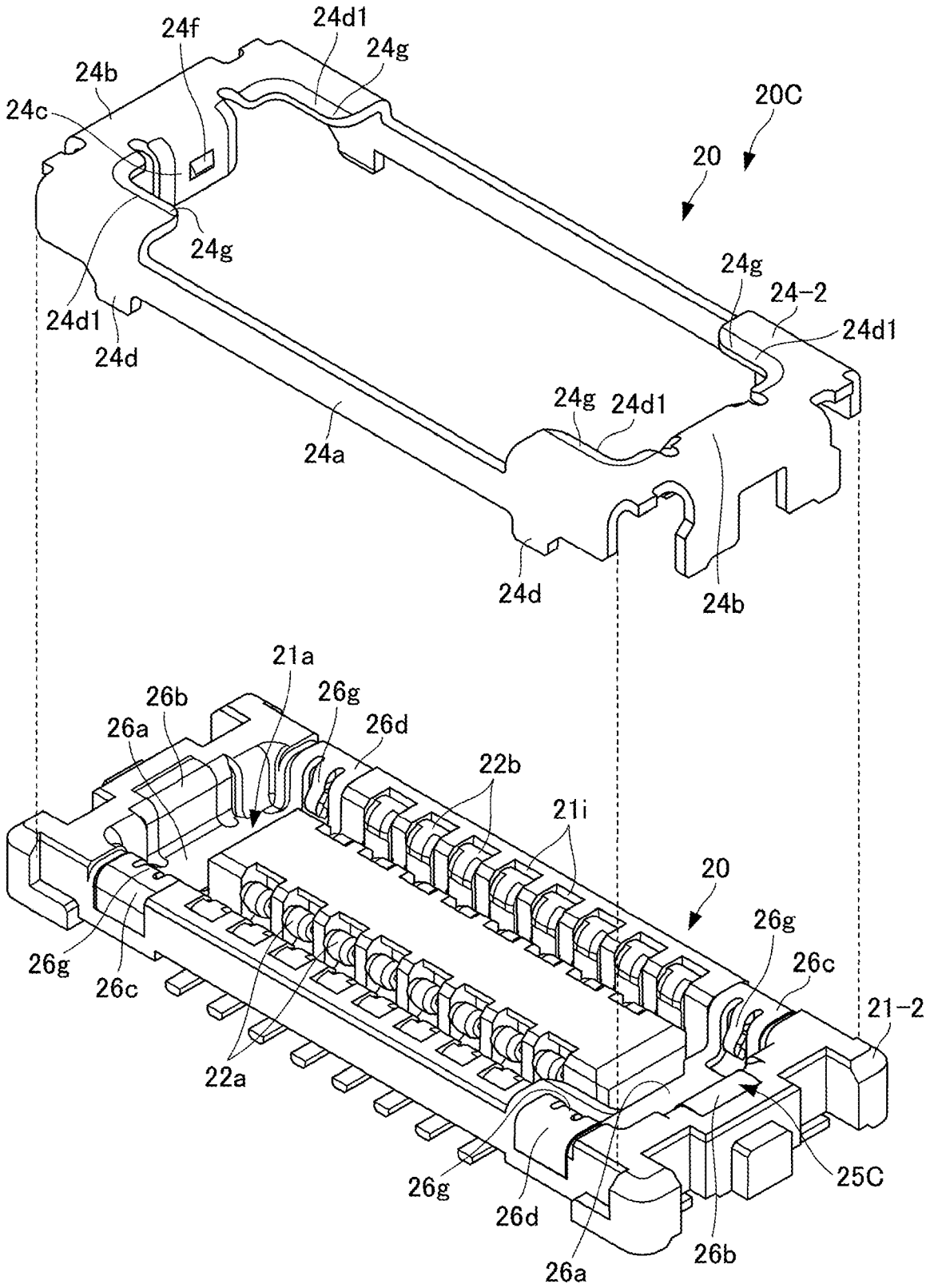
FIG. 16 is an exploded perspective view of the electric connector (socket) according to the third embodiment of the present invention, and an upper side shows an exterior of a reinforcing metal piece, and a lower side shows an exterior of a connector housing to which conductive members are attached.

FIGS. 15A and 15B include exterior perspective views of an electric connector 20C according to a third embodiment of the present invention, where FIG. 15A shows its exterior on a top side, and FIG. 15B shows its exterior on a bottom side. FIG. 16 is an exploded perspective view of the electric connector 16C, and FIG. 17 is a perspective view of conductive members 25C to be attached to the electric connector 20C.

Figure 18A:
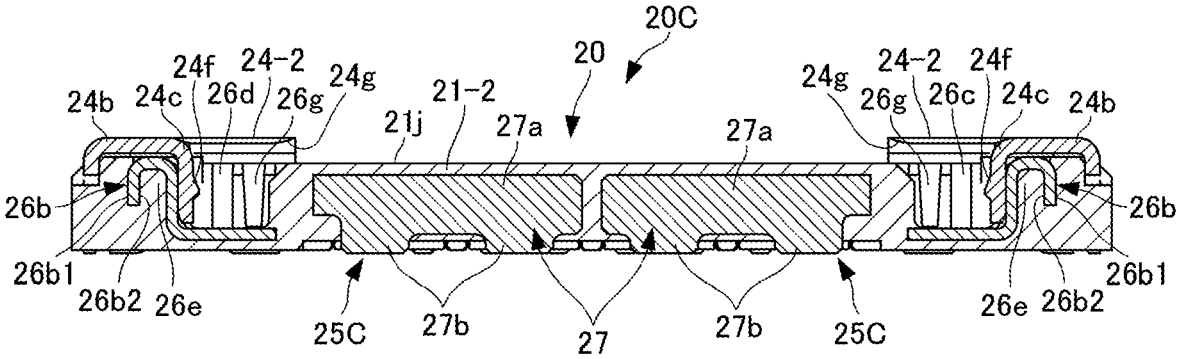
FIG. 18A is a longitudinal cross-sectional view of the electric connector (socket) according to the third embodiment of the present invention.
Figure 18B:
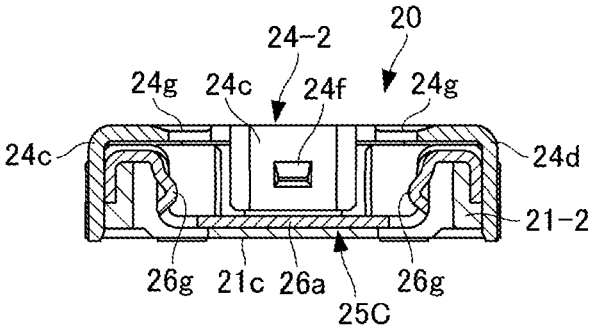
FIG. 18B is a transverse cross-sectional view of a longitudinal end portion of the socket.

Furthermore, FIG. 18A is a longitudinal cross-sectional view of the electric connector 20C to which the conductive members 25C are attached, and FIG. 18B is a transverse cross-sectional view of a longitudinal end portion of the electric connector 20C. Note that, in the electric connector 20C according to the present embodiment, the components same as, or similar to, those of the first embodiment are denoted by the same reference numerals, and differences from the first embodiment will be described.

As shown in FIGS. 15A to 17, the electric connector 20C according to the present embodiment has a connector housing 21-2 to which the conductive members 25C and a reinforcing metal piece 24-2, which are different from the conductive members 25A and the reinforcing metal piece 24 of the electric connector 20A according to the first embodiment, are attached.

Figure 17:
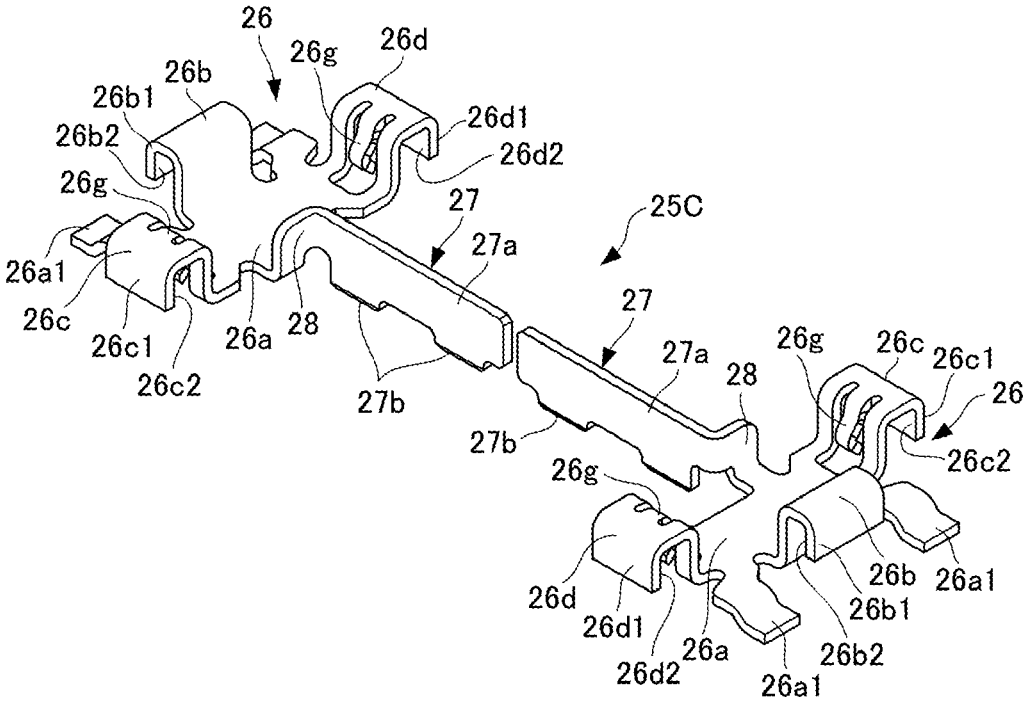
FIG. 17 is a perspective view of the conductive members to be attached to the connector housing of the electric connector (socket) according to the third embodiment of the present invention.

In the conductive member 25C, as shown in FIG. 17, a pair of engagement plate portions 26*g* are provided in each of pairs of side end plates 26*c* and 26*d* of the first plates 26. The engagement plate portions 26*g* are composed of a pair of spring members (plate spring members, in this example) provided in the first plate 26 in positions opposite each other on both sides in a direction perpendicular to the row direction of the connection terminal rows 22*a* and 22*b*. The engagement plate portions 26*g* have, for example, shapes shown in FIGS. 15A, 15B, and 16, and can be elastically deformed so as to move away outward in a lateral direction of the electric connector 20C. Therefore, when the electric connector 20C receives the protruding fitting portion 31*a* of the counterpart electric connector 30A fit into the depressed fitting portion 21*a* of the connector housing 21-2, as described later, the engagement plate portions 26*g* are engaged with the engagement depressed portions 34*f* (see FIGS. 2, 5A, and 5B) of the reinforcing metal piece 34 of the electric connector 30A, by elastic force to bias the engagement plate portions 26*g* toward the above-described shapes.

In the connector housing 21-2 of the electric connector 20C, the two conductive members 25C having the configuration of FIG. 17 are attached along the row direction of the connection terminal rows 22*a* and 22*b* such that end portions of the second plates 27 opposite to the first plates 26 are disposed close to each other. To be more specific, the conductive members 25C are configured such that, as shown in FIGS. 15A, 15B, 16 (see lower drawing), and 18A, the first plates 26 are attached to the connector housing 21-2 on both outsides of the connection terminal rows 22*a* and 22*b* in the row direction of the connection terminals, and the second plates 27 extend in the row direction of the connection terminals between the connection terminal rows 22*a* and 22*b* in the connector housing 21-2. The other configuration of the conductive member 25C is the same as that of the conductive member 25A (see FIG. 6) used in the electric connector 20A according to the first embodiment.

On the other hand, in the electric connector 20C, as shown in FIGS. 15A, 15B, 16, 18A, and 18B, the reinforcing metal piece 24-2 has cover portions 24*g* that cover the engagement plate portions 26*g*, which are disposed oppositely at symmetrical positions in the first plates 26 of the above-described conductive members 25C attached to the connector housing 21-2, at the positions from above, when the reinforcing metal piece 24-2 is mounted on the connector housing 21-2.

In the reinforcing metal piece 24-2, the cover portions 24*g* are formed integrally with the pairs of bent joint portions 24*d* that are joined from the pair of connection plate portions 24*b* at both ends of the connector housing 21-2 in the longitudinal direction. To be more specific, the cover portions 24*g* are formed by, for example, as shown in FIG. 16, extending portions 24*d*1, which are continuous with the pair of connection plate portions 24*b* on the side of upper surfaces of the bent joint portions 24*d* (on the side facing the counterpart connector body 30), by a predetermined length in the longitudinal direction of the connector body 20. Referring to FIGS. 15A and 18A, the cover portions 24*g* have such shapes that the portions 24*d*1 of the pairs of bent joint portions 24*d* of the reinforcing metal piece 24-2, on the side of the upper surface of the connector housing 21-2, extend in the row direction of the connection terminal rows 22*a* and 22*b* to positions over the engagement plate portions 26*g*.

More specifically, for example, as shown in FIG. 18A, as to the longitudinal direction of the connector body 20, the cover portion 24*g* extends to a position of an inner recess of the depressed fitting portion 21*a* over the side end plate 26*b* and the engagement plate portion 26*g* of the first plate 26 of the conductive member 25C attached to the connector housing 21-2. As to the lateral direction of the connector body 20, for example, as shown in FIG. 18B, the cover portion 24*g* extends to a position of an inner recess of the depressed fitting portion 21*a* over the engagement plate portion 26*g* of each of the side end plates 26*c* and 26*d* of the first plate 26 of the conductive member 25C attached to the connector housing 21-2.

In the electric connector 20C including the connector housing 21-2 to which the conductive members 25C and the reinforcing metal piece 24-2 are attached, when the protruding fitting portion 31*a* of the counterpart electric connector 30A is fit into the depressed fitting portion 21*a* of the connector housing 21-2, the engagement plate portions 26*g* formed in the first plates 26 of the conductive members 25C are engaged with the engagement depressed portions 34*f* (see FIGS. 2, 5A, and 5B) formed in the reinforcing metal piece 34 of the electric connector 30A, in order to maintain the engagement by preventing pullout of the electric connector 30A. As described above, in the electric connector 20C, the conductive member 25C attached to the connector housing 21-2 has the engagement plate portions 26*g*, as elastic holding members that are provided on both sides in the row width direction of the connection terminal rows 22*a* and 22*b* of the first plate 26, and are engaged with the engagement depressed portions 34*f* (engagement portions) of the electric connector 30A, in protrusion-depression engagement of the counterpart electric connector 30A (see FIGS. 2, 5A, and 5B), to elastically hold the electric connector 30A.

In the electric connector 20C, when the counterpart electric connector 30A is protrusion-depression engaged, for example, as shown in FIG. 15A, the reinforcing metal piece 24-2 is mounted on the connector housing 21-2 in such a state that the pairs of internal and external end plate portions 24*c* of the reinforcing metal piece 24 overlap with the pair of side end plates 26*b* of the conductive members 25C at both ends in the row direction. At this time, on the side of the bottom surface of the electric connector 20C, as shown in FIG. 15B, the ground connection portions 26*a*1 of the first plates 26 of the conductive members 25C and the ground connection portions 27*b* of the second plates 27 are exposed to the side of the substrate facing surface 21*c* of the connector housing 21-2.

Therefore, in the electric connector 20C, the ground connection portions 27*b* and 26*b*1 of the conductive members 25C are easily ground-connected to the circuit substrate P (see FIG. 2) on the side of the substrate facing surface 21*c* of the connector housing 21-2. In the electric connector 20C, the side end plates 26*b* of the first plates 26 of the individual conductive members 25B attached to the connector housing 21-2 are in contact with the end plate portions 24*c* of the reinforcing metal piece 24-2, and are connected to the reinforcing metal pieces 24-2 and 34 in the row width direction at the outsides of the male and female connection terminal rows 22*a* and 22*b* in the row direction thereof. In this state, a ground shield effect due to the conductive members 25C can be obtained.

In the electric connector 20C including the connector housing 21-2 having the above-described configuration, the pairs of engagement plate portions 26*g* provided in the side end plates 26*c* and 26*d* of the first plates 26 of the conductive members 25C are covered with the cover portions 24*g* formed in the reinforcing metal piece 24-2 from above. Therefore, when the protruding fitting portion 31*a* of the counterpart electric connector 30A is received into the depressed fitting portion 21*a* of the connector housing 21-2 of the electric connector 20C (see FIGS. 11A and 11B), the cover portions 24*g* of the reinforcing metal piece 24-2 are in contact with the electric connector 30A at front positions of the pair of engagement plate portions 26*g*, and hence has the effect of preventing interference of the electric connector 30A with the engagement plate portions 26*g*.

The cover portions 24*g* are formed integrally with the reinforcing metal piece 24-2, and therefore has strength of the same order of the reinforcing metal piece 24-2. Therefore, when the counterpart electric connector 30A is protrusion-depression engaged, so-called alignment operation, i.e. position adjustment of the electric connector 30A in the longitudinal direction or the lateral direction, or posture adjustment to make the electric connector 30A have a right fitting angle (Z direction in FIG. 1), can be performed while part of the electric connector 30A is caused to abut against the cover portions 24*g*.

As described above, in the electric connector 20C according to the third embodiment, the conductive member 25C has the engagement plate portions 26*g*, as the elastic holding members that are provided on both sides in the row width direction of the connection terminal rows 22*a* and 22*b* of the first plate 26, and are engaged with the engagement depressed portions 34*f* (engaging portions) of the counterpart electric connector 30A, at the time of protrusion-depression engagement, to elastically hold the counterpart electric connector 30A, and the reinforcing metal piece 24 has the cover portion 24*g* that covers the engagement plate portions 26*g* from above.

Therefore, the electric connector 20C according to the present embodiment can realize stable electric connection without having an influence on the posture of the electric connector 30A, while preventing interference of the electric connector 30A with the engagement plate portions 26*g*, at the time of fit and removal of the counterpart electric connector 30A.

In the electric connector 20C according to the present embodiment, the engagement plate portions 26*g* are composed of a pair of spring members that are provided in the first plate 26 in positions opposite each other on both sides in the direction perpendicular to the row direction of the connection terminal rows 22*a* and 22*b*. The configuration of the electric connector 20C having the engagement plate portions 26*g* provided in the positions opposite each other, i.e. symmetrical positions can prevent a tilt in the posture of the counterpart electric connector 30A, and therefore prevent unstable electric connection, as compared with a case where the engagement plate portions 26*g* are provided asymmetrically.

In each of the above-described embodiments, the first plates 26 of the conductive members 25A, 25B, and 25C are connected to the ground, but when the first plates 26 are used as power terminals, the conductive members 25A, 25B, and 25C and the reinforcing metal pieces 24 and 24-2 electrically connected thereto are not connected to the ground.

As described above, the embodiment(s) of the present invention can provide the electric connectors 20A, 20B, and 20C that have a high stiffness sufficient to resist damage by a force relating to fit and removal of the counterpart electric connector 30A, as well as having stable electric connection, and the electric connector set 10. The present invention is applicable to general electric connectors each of which has a socket mounted on a circuit substrate and a plug protrusion-depression engaged with the socket.

REFERENCE SIGNS LIST

10 electric connector set
20A, 20B, 20C electric connector
21, 21-1, 21-2 connector housing
21*a* depressed fitting portion
21*h*, 21*i* terminal holder
22*a*, 22*b* connection terminal row
24, 24-2 reinforcing metal piece
24*f* engagement protruding portion
24*g* cover portion
25A, 25B, 25C conductive member
first plate
26*a* plate surface
26*a*1 ground connection portion
26*b* side end plate
26*b*5 ground connection portion
26*g* engagement plate portion
27 second plate
27*a* plate surface
28 joint plate
30A electric connector
31 connector housing
34 reinforcing metal piece

The invention claimed is:

1. An electric connector comprising:

a first connector housing configured to be able to be protrusion-depression engaged with a second connector housing of a counterpart connector in an opposed direction;

a plurality of connection terminal rows arranged approximately in a same plane in the first connector housing;

a conductive member having conductive first plates attached to the first connector housing on both outsides of the connection terminal rows in a row direction of connection terminals; and a conductive reinforcing metal piece extending along the first connector housing, the reinforcing metal piece being mounted on the first connector housing in such a state that at least part of the reinforcing metal piece overlaps with at least part of the first plates, wherein the conductive member and the reinforcing metal piece are included in one of the first connector housing and the second connector housing, and the reinforcing metal piece has a cover portion that covers elastic holding members in the conductive member in a connecting direction between the first connector housing and the second connector housing of the counterpart connector.

2. The electric connector according to claim 1, wherein the conductive member further includes a conductive second plate that is provided in the connector housing and extends between the connection terminal rows in the row direction of the connection terminals, and the first plates and the second plate are joined into an integral piece.

3. The electric connector according to claim 2, wherein the conductive member has joint plates configured to join the first plates and the second plate, and the joint plates are orthogonal to plate surfaces of the first plates and a plate surface of the second plate.

4. The electric connector according to claim 3, wherein the joint plates are exposed from the first connector housing outward in the row direction of the connection terminal rows.

5. The electric connector according to claim 1, wherein the elastic holding members are provided in the first plate on both sides in a row width direction of the connection terminal rows, and are configured to elastically hold the counterpart connector by engaging with engagement portions of the counterpart connector at a time of protrusion-depression engagement.

6. An electric connector comprising:

a connector housing configured to be able to be protrusion-depression engaged with a connector housing of a counterpart connector in an opposed direction;

a plurality of connection terminal rows arranged approximately in a same plane in the connector housing;

a conductive member having conductive first plates attached to the connector housing on both outsides of the connection terminal rows in a row direction of connection terminals; and a conductive reinforcing metal piece extending along the connector housing, the reinforcing metal piece being mounted on the connector housing in such a state that at least part of the reinforcing metal piece overlaps with at least part of the first plates;

wherein the conductive member has elastic holding members that are provided in the first plate on both sides in a row width direction of the connection terminal rows, and configured to elastically hold the counterpart connector by engaging with engagement portions of the counterpart connector at the time of protrusion-depression engagement, the reinforcing metal piece has a cover portion configured to cover the elastic holding members from above, and the elastic holding members are composed of a pair of spring members that are provided in the first plate in positions opposite each other on both sides in a direction perpendicular to the row direction of the connection terminal rows.

7. An electric connector set comprising the electric connector according to claim 1, and the counterpart connector.

* * * * *